US008466846B1

(12) United States Patent
Elsallal et al.

(10) Patent No.: US 8,466,846 B1
(45) Date of Patent: Jun. 18, 2013

(54) ULTRA WIDE BAND BALANCED ANTIPODAL TAPERED SLOT ANTENNA AND ARRAY WITH EDGE TREATMENT

(75) Inventors: Modhwajih A. Elsallal, Cedar Rapids, IA (US); John C. Mather, Cedar Rapids, IA (US); Lee M. Paulsen, Cedar Rapids, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 336 days.

(21) Appl. No.: 12/893,585

(22) Filed: Sep. 29, 2010

(51) Int. Cl.
*H01Q 13/10* (2006.01)
*H01Q 1/38* (2006.01)

(52) U.S. Cl.
USPC ..... 343/770; 343/767; 343/700 MS

(58) Field of Classification Search
None
See application file for complete search history.

(56) References Cited

U.S. PATENT DOCUMENTS

| | | | | |
|---|---|---|---|---|
| 3,836,976 | A * | 9/1974 | Monser et al. | 343/795 |
| 5,227,808 | A * | 7/1993 | Davis | 343/915 |
| 5,309,165 | A * | 5/1994 | Segal et al. | 343/770 |
| 5,557,291 | A * | 9/1996 | Chu et al. | 343/725 |
| 5,786,792 | A * | 7/1998 | Bellus et al. | 343/770 |
| 6,552,691 | B2 * | 4/2003 | Mohuchy et al. | 343/770 |
| 7,088,300 | B2 * | 8/2006 | Fisher | 343/767 |
| 2007/0171140 | A1 * | 7/2007 | Minard et al. | 343/770 |
| 2008/0211726 | A1 | 9/2008 | Elsallal et al. | |

OTHER PUBLICATIONS

J.D.S. Langley, "Balanced antipodal Vivaldi antenna for wide bandwidth phased arrays", IEE Proc. -Microw. Antennas Propag., vol. 143, No. 2, Apr. 1996; pp. 98-102.*

N. Schuneman, J. Irion and R. Hodges, "Decade Bandwidth Tapered Notch Antenna Array Element," Proceedings of the 2001 Antenna Applications Symposium—vol. II, Sep. 19-21, 2001; pp. 280-294; Monticello, IL; 17 pages.

M. Stasiowski and D. H. Schaubert, "Broadband Phased Array," 2008 Antenna Applications Symposium, Sep. 16-18, 2008; pp. 17-41; Monticello, IL; 18 pages.

D. H. Schaubert, A.O. Boryssenko, M.N. Vouvakis, G. Paraschos, W. Elsallal and S. Kasturi, "Wide Bandwidth Arrays of Vivaldi Antennas," Organized by the Institution of Engineering and Technology Antennas and Propagation Network; Copyright The IET; 2008 Institution of Engineering and Technology Seminar on Wideband, Multiband Antennas and Arrays for Defence or Civil Applications; 21 pages.

J. J. Lee and S. Livingston, "Wide Band Bunny-Ear Radiating Element," Copyright 1993 IEEE; Antennas and Propagation Society International Symposium, Jun. 28-Jul. 2, 1993; pp. 1604-1607 vol. 3; 5 pages.

(Continued)

*Primary Examiner* — Trinh Dinh
(74) *Attorney, Agent, or Firm* — Donna P. Suchy; Daniel M. Barbieri

(57) ABSTRACT

The present disclosure is directed to a dual-polarized antenna array including a first BAVA, a second BAVA and a cradle assembly. The cradle assembly includes first, second and third U-channel modules connected via first and second frame portions. The first U-channel module, the second U-channel module, and the first frame portion receive first, second and third edge portions of a substrate of the first BAVA, respectively. The second U-channel module, the third U-channel module, and the second frame portion receive first, second and third edge portions of a substrate of the second BAVA, respectively. When received within the cradle assembly, the substrate of the first BAVA is oriented perpendicular to the substrate of the second BAVA. The first BAVA is a vertical polarization input and the second BAVA is a horizontal polarization input.

9 Claims, 17 Drawing Sheets

OTHER PUBLICATIONS

J. J. Lee, S. Livingston, and R. Koenig, "Performance of a Wideband (3-14 GHz) Dual-pol Array," Copyright 2004 IEEE; Antennas Propagation Society International Symposium, Jun. 20-25, 2004; pp. 551-554 vol. 1; 5 pages.

B. Munk, R. Taylor, T. Durham, W. Croswell, B. Pigon, R. Boozer, S. Brown, M. Jones, J. Pryor, S. Ortiz, J. Rawnick, K. Krebs, M. Vanstrum, G. Gothard and D. Wiebelt, "A Low-Profile Broadband Phased Array Antenna," Copyright 2003 IEEE; Antennas and Propagation Society International Symposium, Jun. 22-27, 2003; pp. 448-451 vol. 2; 5 pages.

P. Friederich, L. Pringle, L. Fountain, P. Harms, D. Denison, E. Kuster, S. Blalock, G. Smith, J. Maloney and M. Kesler, "A New Class of Broadband Planar Apertures," Proceedings of the 2001 Antenna Applications Symposium—vol. II, Sep. 19-21, 2001; pp. 561-587; Monticello, IL; 29 pages.

B. Thors, and H. Steyskal, "Synthesis of Planar Broadband Phased Array Elements with a Genetic Algorithm," Proceedings of the 2005 Antenna Applications Symposium, Sep. 21-23, 2005; pp. 324-344; Monticello, IL; 22 pages.

W.R. Pickles, J.B.L. Rao, D.P. Patel, and R. Mital, "Coincident Phase Center Ultra Wideband Array of Dual Polarized Flared Notch Elements" Copyright 2007 IEEE; Antennas and Propagation Society International Symposium, Jun. 9-15, 2007; pp. 4421-4424; 5 pages.

* cited by examiner

ULTRA WIDE BAND BALANCED ANTIPODAL TAPERED SLOT ANTENNA AND ARRAY WITH EDGE TREATMENT

CROSS-REFERENCE TO RELATED APPLICATIONS

The following patent application is incorporated by reference in its entirety: Ser. No. 12/893,648

FIELD OF THE INVENTION

The present invention relates to the field of antennas and more particularly to an edge-treated antenna and array (ex.—tapered slot antenna, notch antenna, Vivaldi, Balanced Antipodal Vivaldi Antenna (AVA), Bunny Ears antenna) for achieving ultra wide-band (UWB) performance.

BACKGROUND OF THE INVENTION

A number of currently available Balanced Antipodal Vivaldi Antennas (BAVAs) and/or BAVA arrays may not provide a desired level of performance over a desired bandwidth range (ex.—over a broad bandwidth). Further, currently available BAVAs and/or BAVA arrays may not provide desirable capacitance and impedance matching characteristics. Still further, currently available BAVAs and/or BAVA arrays may not have desirable Size, Weight, Power and Cost (SWAP-C) characteristics.

Thus, it would be desirable to have a BAVA (ex.—BAVA antenna) and/or BAVA array which addresses the problems associated with currently available solutions.

SUMMARY OF THE INVENTION

Accordingly an embodiment of the present disclosure is directed to a unit cell, including: a Balanced Antipodal Vivaldi Antenna (BAVA); and a post assembly, the post assembly configured for receiving the BAVA, the post assembly including a base plate, the post assembly further including a plurality of channel modules, said plurality of channel modules being connected to the base plate, wherein a first channel module included in the plurality of channel modules is configured for receiving, via a channel (ex.—U-shaped channel) of the first channel module, a first edge portion of a substrate of the BAVA, a second channel module included in the plurality of channel modules is configured for receiving, via a channel (ex.—U-shaped channel) of the second channel module, a second edge portion of the substrate of the BAVA, and the base plate is configured for receiving, via an aperture formed through the base plate, a third edge portion of the substrate of the BAVA. The substrate is received within the post assembly such that the channel modules are neither in physical contact with, nor are they in electrical contact with conductors of the BAVA. Thus, the channel modules may not (ex.—need not) be in physical and/or electrical contact with conductors of the BAVA.

A further embodiment of the present disclosure is directed to a dual-polarized antenna array, including: a first Balanced Antipodal Vivaldi Antenna (BAVA); a second BAVA; and a cradle assembly, the cradle assembly configured for receiving the first BAVA and the second BAVA, the cradle assembly including a first channel module, a second channel module, and a third channel module, the first, second and third channel modules being connected to a frame of the cradle assembly, the frame including a first frame portion connected to a second frame portion, wherein the first and second channel modules are configured for receiving a substrate of the first BAVA, the second and third channel modules being configured for receiving a substrate of the second BAVA, the first BAVA being a vertical polarization input, and the second BAVA being a horizontal polarization input.

A still further embodiment of the present disclosure is directed to a dual-polarized antenna array, including: a first Balanced Antipodal Vivaldi Antenna (BAVA); a second BAVA; and a cradle assembly, the cradle assembly configured for receiving the first BAVA and the second BAVA, the cradle assembly including a first channel module, a second channel module, and a third channel module, the first, second and third channel modules being connected to a frame of the cradle assembly, the frame including a first frame portion connected to a second frame portion, wherein a U-shaped channel of the first channel module receives a first edge portion of a substrate of the first BAVA, a first U-shaped channel of the second channel module receives a second edge portion of the substrate of the first BAVA, an aperture of the first frame portion receives a third edge portion of the substrate of the first BAVA, a second U-shaped channel of the second channel module receives a first edge portion of a substrate of the second BAVA, a channel of the third channel module receives a second edge portion of the substrate of the second BAVA, and an aperture of the second frame portion receives a third edge portion of the substrate of the second BAVA, the first BAVA being a vertical polarization input, and the second BAVA being a horizontal polarization input, the substrate of the first BAVA being oriented perpendicular to the substrate of the second BAVA.

A further embodiment of the present disclosure is directed to a Balanced Antipodal Vivaldi Antenna (BAVA), including: a substrate; and a plurality of (ex.—two or more) conductors connected to the substrate, the plurality of conductors including a first outer conductor, a second outer conductor and an embedded conductor, the first outer conductor being configured upon a first external surface of the BAVA substrate, the second outer conductor being configured upon a second external surface of the BAVA substrate, the first external surface and the second external surface being located on a generally opposite external faces of the substrate, the embedded conductor being embedded within the substrate, wherein at least one conductor included in the plurality of conductors includes a multi-curve surface, said multi-curve surface including a plurality of curved sub-portions, a first curved sub-portion included in the plurality of curved sub-portions being controlled by a first opening rate and a second curved sub-portion included in the plurality of sub-portions being controlled by a second opening rate, the second opening rate being a different rate than the first opening rate.

A still further embodiment of the present invention is directed to a Balanced Antipodal Vivaldi Antenna (BAVA), including: a substrate; and a plurality of conductors connected to the substrate, the plurality of conductors including a first outer conductor, a second outer conductor, a third outer conductor, a fourth outer conductor, a first embedded conductor, and a second embedded conductor, the first outer conductor and the third outer conductor being configured upon a first external surface of the BAVA substrate, the second outer conductor and the fourth outer conductor being configured upon a second external surface of the BAVA substrate, the first external surface and the second external surface being located on a generally opposite external faces of the substrate, the first embedded conductor and the second embedded conductor being embedded within the substrate, wherein at least one conductor included in the plurality of conductors includes a multi-curve surface, said multi-curve surface including a plurality of curved sub-portions, a first curved sub-portion included in the plurality of curved sub-portions being controlled by a first opening rate and a second curved sub-portion included in the plurality of sub-portions being controlled by a second opening rate, the second opening rate being a different rate than the first opening rate.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present disclosure may be better understood by those skilled in the art by reference to the accompanying figures in which.

DETAILED DESCRIPTION OF THE INVENTION

Figure 3:
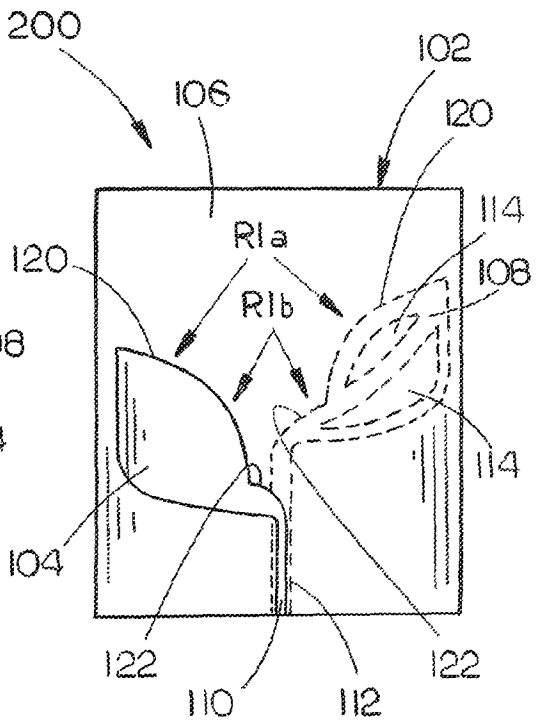
FIG. 3 is a top plan view of an asymmetric BAVA having multi-stage fins, in accordance with a further exemplary embodiment of the present disclosure.

Reference will now be made in detail to the presently preferred embodiments of the invention, examples of which are illustrated in the accompanying drawings.

The traditional design of a Tapered slot antenna (TSA) is capable of operating over a wide range of frequencies (10:1) at wide scan-angles (see: N. Schuneman, J. Irion and R. Hodges, "Decade Bandwidth Tapered Notch Antenna Array Element," Antenna Applications Symposium, pp. 280-294, 19-21 Sep. 2001. Monticello, Ill. and M. Stasiowski, D. H. Schaubert, "Broadband Phased Array," 2008 Antenna Applications Symposium, Allerton Park, Monticello, Ill., pp. 17-41, 16-18 Sep., 2008. Monticello, Ill., both of which are incorporated herein by reference). However, contiguous electrical contact between neighboring elements is required to sustain the wideband operation. This increases the cost of the assembly of a large dual-polarized Vivaldi array. In addition, it is labor extensive to repair to repair the soldered elements of the array. Inserting gaps between the neighboring Vivaldi elements produces severe impedance anomalies that disrupt the operating band of the array (see: "Wide Bandwidth Arrays of Vivaldi Antennas", Schaubert D. H.; ElSallal, W.; Katsuri S.; Boryssenko, A. O.; Vouvakis, M. N., Paraschos, G., 2008 Institution of Engineering and Technology Seminar, Publication Year 2008, Pages 1-20, which is herein incorporated by reference). It is suspected that these anomalies are not purely an elemental effect but also are the result of high mutual coupling between the elements.

The Bunny-Ear antenna was first introduced in 1993 as a wideband single element radiator (see J. J. Lee, and S Livingston, "Wideband Bunny-Ear Radiating Element," IEEE Antenna and Propagation Symposium, pp. 1604-1607, 28 Jun.-2 Jul. 1993, which is herein incorporated by reference).

J. J. Lee et al. published results of that antenna exhibiting 4:1 bandwidth in a dual-polarized array without contiguous electrical contact between adjoining elements (see J. J. Lee, S Livingston and R. Koenig, "Performance of a Wideband (3-14 GHz) Dual-Pol Array," IEEE Antenna Propagation Symposium, pp. 551-554, 20-25 Jun. 2004, which is herein incorporated by reference). However, it is necessary to connect film resistors in the gaps between antenna arms and the ground plane to suppress electromagnetic resonances caused by the gap. Installation of these lumped elements hinders future maintenance. In addition, the element plus the coaxial-to-slot balun transition increases the depth of the antenna about one wavelength at the highest frequency of operation.

Munk and others have developed arrays of printed dipoles with capacitive coupling between elements (see B. Munk, R. Taylor, T. Durharn, W. Croswell, B. Pigon, R. Boozer, S. Brown, M. Jones, J. Pryor, S. Ortiz, J. Rawnick, K. Kerbs, M. Vanstrum, G. Gothard and D. Wiebelt, "A Low-Profile Broadband Phased Array Antenna," IEEE Antenna and Propagation Symposium, pp. 448-451, 22-27 Jun. 2003, which is herein incorporated by reference). The dipole array worked over wide bandwidths and scans over wide ranges, but it required multiple layers of dielectrics to achieve good performance, and the balanced dipoles required a balun for operation with common microwave transmission lines, which are unbalanced. Also, the end-to-end capacitance of the dipoles was difficult to achieve if modular construction was desired.

The fragmented aperture antenna array (see P. Friederich, L. Pringle, L. Fountain, P. Harms, D. Denison, E. Kuster, S. Blalock, G. Smith, J. Maloney and M. Kesler, "A New Class of Broadband Planar Apertures," Antenna Applications Symposium, pp. 561-587, 19-21 Sep., 2001. Monticello, Ill. and B. Thors, and H. Steyskal, "Synthesis of Planar Broadband Phased Array Elements with a Genetic Algorithm," Antenna Applications Symposium, pp. 324-344, 21-23 Sep., 2005. Monticello, Ill., both of which are herein incorporated by reference) appears to provide wide bandwidth and wide scanning. Like the dipole arrays of Munk, fragmented aperture arrays require layers of dielectric superstrates and seem to require relatively stringent tolerances for element-to-element coupling, making them less amenable to modular construction.

US Patent Publication No: US 2008/0211726 A1, entitled: "Wide bandwidth Balanced Antipodal Tapered Slot Antenna and Array Including a Magnetic Slot," (which is herein incorporated by reference) describes a 5:1 bandwidth array in which the elements are said to be modular. However, the metallic walls are needed between the adjoining single polarized elements in the array environment to avoid impedance anomalies and scan blindness. Furthermore, doubly-mirroring technique is required to improve scan impedance off-boresight. This technique might not be cost-attractive because it requires 180 degree of phase shift between neighboring elements.

The enhancement in the present disclosure allows significant advantages over competing technologies as it has the lowest profile (element depth is less than ½ wavelength at the highest frequency of operation), and works in a dual-polarized array over a decade (10:1) bandwidth with wide scan volume (±60°).

One of the key parameters for a Balanced Antipodal Vivaldi Antenna (BAVA) is its opening rate, R1. Opening rate (R1) controls the shape and depth of an element's active reflection coefficient curve. Usually, there is a large hump in an active Voltage Standing Wave Ratio (VSWR) plot of a Doubly-Mirrored Balanced Antipodal Vivaldi Antenna with Magnetic Slot (DmBAVA-MAS) element in infinite arrays.

Figure 1:
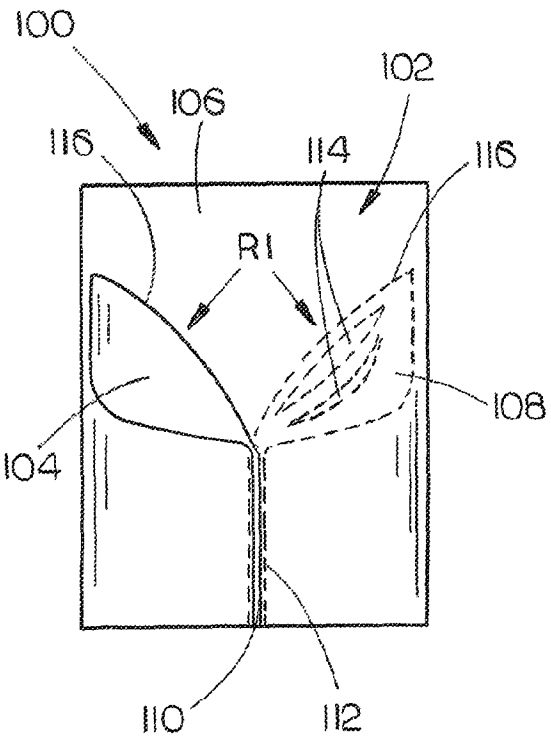
FIG. 1 is a top plan view of a Balanced Antipodal Vivaldi Antenna (BAVA)

Referring to FIG. 1, a Balance Antipodal Tapered Slot Antenna (ex.—a BAVA) having a single opening rate (R1) is shown. In an exemplary embodiment of the present disclosure, the BAVA 100 (ex.—BAVA antenna, BAVA antenna element) includes a substrate 102. For example, the substrate 102 may be formed of dielectric material. In further embodiments of the present disclosure, the BAVA 100 includes a first outer conductor 104, said first outer conductor 104 being connected to (ex.—configured upon) a first (ex.—top) external surface 106 (ex.—ground plane, face) of the substrate 102. In current exemplary embodiments of the present disclosure, the BAVA 100 further includes a second outer conductor (not shown), said second outer conductor being connected to (ex.—configured upon) a second (ex.—bottom) external surface (ex.—ground plane, face) (not shown) of the substrate 102. In further embodiments of the present disclosure, the BAVA further includes an embedded conductor 108, said embedded conductor being embedded within the substrate 102 (ex.—in a stripline layer) and being configured (ex.—located) between the first outer conductor 104 and the second outer conductor (not shown).

In current exemplary embodiments of the present disclosure, the BAVA 100 includes a first feed structure 110, said first feed structure 110 being connected to the first outer conductor and being configured for providing an electrical feed for the first outer conductor 104. In further embodiments of the present disclosure, the BAVA 100 includes a second feed structure 112, said second feed structure 112 being connected to the embedded conductor 108 and being configured for providing an electrical feed for the embedded conductor 108. In exemplary embodiments of the present disclosure, the BAVA 100 includes a third feed structure (not shown), said third feed structure being connected to the second outer conductor (not shown) and being configured for providing an electrical feed for the second outer conductor. In further embodiments of the present disclosure, the embedded conductor 108 may have a plurality of apertures (ex.—slots, notches) 114 formed therein. In still further embodiments of the present disclosure, the first outer conductor 104, second outer conductor (not shown) and the embedded conductor 108 are flared conductors, each having a curved surface 116.

Figure 2:
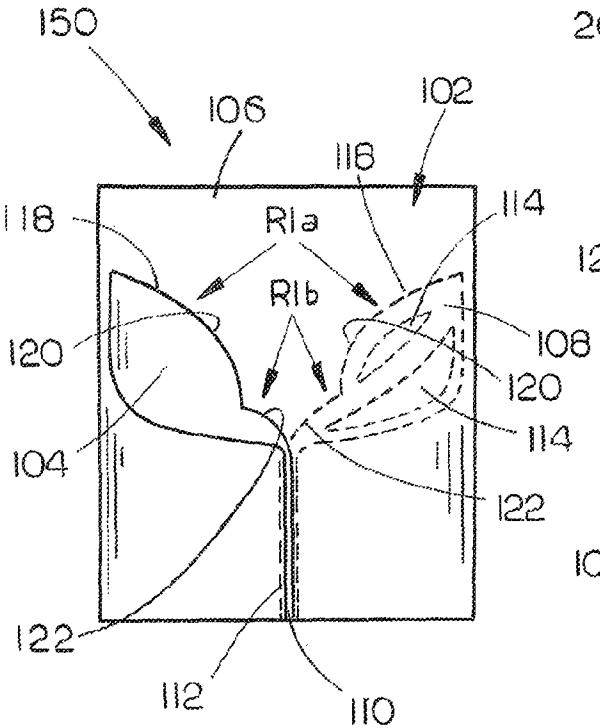
FIG. 2 is a top plan view of a BAVA having multi-stage conductors (ex.—fins) in accordance with a further exemplary embodiment of the present disclosure.

The flared conductors of the BAVA 100 shown in FIG. 1 appear to serve as a single-stage impedance transformer for the traveling wave from the radiating element into free space. Some performance improvement may be achieved by modifying the shape of the flared conductors to mimic a multiple-stage impedance transformer. FIG. 2 illustrates a BAVA 150 in accordance with a further exemplary embodiment of the present disclosure. In the embodiment shown in FIG. 2, the BAVA 150 is similar to and/or is constructed in a similar manner as the BAVA 100 of FIG. 1, except that the curved surface of each flared conductor of the BAVA 150 in FIG. 2 is formed as a multi-curve surface 118, each multi-curve surface 118 having multiple (ex.—two or more) exponential (or arbitrary) curved sub-portions (ex.—curves) 120, 122. In further embodiments of the present disclosure, the first set of curves 120 may be controlled by a first opening rate (R1*a*), while the second set of curves 122 may be controlled by a second opening rate (R1*b*), the second opening rate (R1*b*) being different (ex.—unique) from the first opening rate (R1*a*).

The values of the unique opening rates (R1*a* and R1*b*) may be optimized to achieve best response in the impedance match. The multi-stage design of the BAVA 150 shown in FIG. 2 may offer better control on active VSWR over a desired operating frequency band. Further, the BAVA 150 shown in FIG. 2 may be particularly attractive for ultra-wideband phased array applications.

Referring to FIG. 3, a BAVA 200 in accordance with a further exemplary embodiment of the present disclosure is shown. The BAVA 200 may be similar to and/or constructed in a manner similar to the BAVA 150 shown in FIG. 2, except that the embedded conductor 108 of the BAVA 200 may be a different height than the first outer conductor 106 and the second outer conductor (not shown), thereby promoting alignment of the BAVA 200 (ex.—radiating element) with a conformal surface and also promoting retention of required array spacing from array theory to prevent grating lobe problems.

Figure 4:
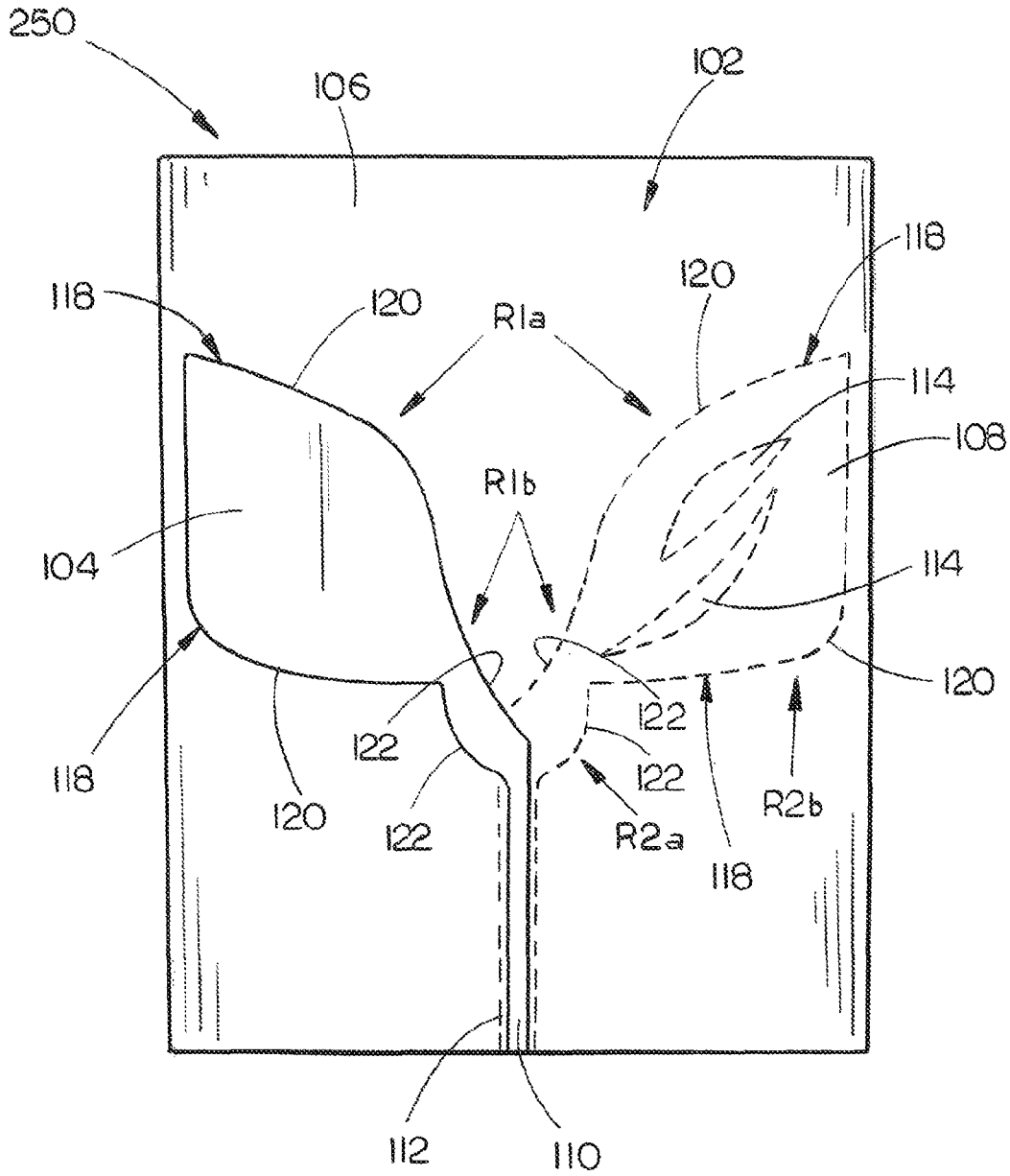
FIG. 4 is a top plan view of a BAVA utilizing multiple opening rates in both the upper and lower-multi-curve surfaces of its fins (ex.—arms) in accordance with a further exemplary embodiment of the present disclosure.

Referring to FIG. 4, a BAVA 250 in accordance with a further exemplary embodiment of the present disclosure is shown. The BAVA 250 may be similar to and/or constructed in a manner similar to the BAVA 150 shown in FIG. 2, except that for the BAVA 250 shown in FIG. 4 each conductor may include a plurality of (ex.—two) multi-curve surfaces 118 (ex.—upper and lower multi-curve surfaces), each multi-curve surface 118 having multiple (ex.—two, three) exponential curved sub-portions (ex.—curves) 120, 122. In further embodiments of the present disclosure, the first set of curves 120 of the upper multi-curve surfaces 118 of the conductors may be controlled by a first opening rate (R1*a*), the second set of curves 122 of the upper multi-curve surfaces 118 of the conductors may be controlled by a second opening rate (R1*b*), the first set of curves 120 of the lower multi-curve surfaces 118 of the conductors may be controlled by a third opening rate (R2*a*), and the second set of curves 122 of the lower multi-curve surfaces 118 of the conductors may be controlled by a fourth opening rate (R2*b*). The first, second, third and fourth opening rates may all be unique values relative to each other. By utilizing more than one opening rate in the upper and lower multi-curve surfaces, the BAVA 250 shown in FIG. 4 may promote improved impedance matching capabilities over currently available BAVA designs. The multi-stage design discussed above may be implemented with various shapes of tapered slot radiating elements, such as Balanced Antipodal Asymmetric Vivaldi Antennas ($BA^2VA$), Asymmetric Vivaldi Antennas (AVAs), Balanced Antipodal Dipole Antennas and traditional Vivaldi Antennas.

Figure 5:
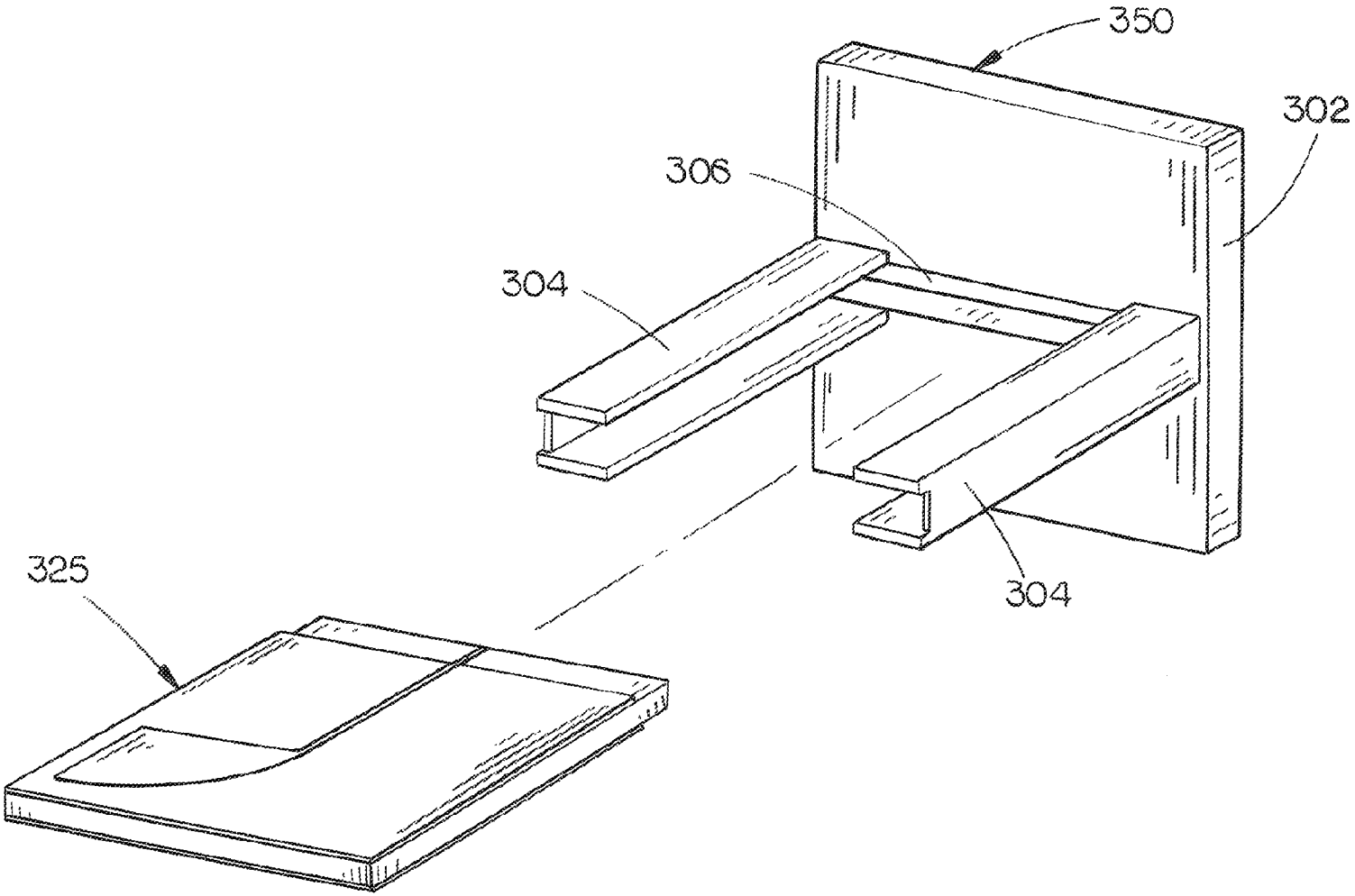
FIG. 5 is an exploded view of a BAVA unit cell in accordance with an exemplary embodiment of the present disclosure.

Referring to FIG. 5, a BAVA unit cell in accordance with an exemplary embodiment of the present disclosure is shown. The BAVA unit cell 300 includes a BAVA 325 and a post assembly (ex.—metallic post assembly) 350. For example, the BAVA 325 may be any one of the BAVA embodiments discussed in the present disclosure and/or may be constructed to include features of any one of the BAVA embodiments discussed in the present disclosure. In further embodiments of the present disclosure, the metallic post assembly 350 may include a base plate 302 and a plurality of channel modules 304, said plurality of channel modules 304 being connected to the base plate 302. In current exemplary embodiments of the present disclosure, the base plate 302 has an aperture (ex.—slot) 306 formed therethrough, said slot 306 being sized and shaped for receiving the BAVA 325.

In the embodiment shown in FIG. 5, the base plate 302 has a first (ex.—front) surface 308 and a second (ex.—rear) surface 310. The channel modules 304 may be configured upon (ex.—connected to) the front surface 308. In further embodiments of the present disclosure, the channel modules 304 are configured as elongated U-shaped brackets and are oriented parallel to each other and are aligned and sized to correspond with the slot 306 as shown in FIG. 5. In still further embodiments of the present disclosure, the channel modules 304 are each sized and shaped for receiving at least a portion of the BAVA 325. In the embodiment shown in FIG. 5, the metallic post assembly 350 may be a rear-engage metallic post assembly 350. For example, the BAVA 325 may be engaged with the metallic post assembly 350 by directing (ex.—sliding) the BAVA 325 via the rear surface 310 through the slot 306, further directing the BAVA towards the front surface 308 so that opposing edge portions of the BAVA 325 are slidably received via end portions of the channel modules (ex.—U-shaped brackets) 304 and so that the BAVA 325 (ex.—said edge portions of the BAVA 325) may be seated within the U-shaped brackets 304 (ex.—within the U-channels, within the air-filled or other dielectric material-filled slots) to form the BAVA unit cell 300. In further embodiments of the present disclosure, the channel modules (ex.—U-channel modules) 304 may be constructed with wire Electrical Discharge Machining (wire EDM), casting, Printed Circuit Board (PCB)-based and/or other fabrication processes.

In exemplary embodiments of the present disclosure, the metallic post assembly 350 is constructed such that when the BAVA 325 is engaged with the metallic post assembly 350 and the edge portions of the BAVA are seated within the U-channels 304, only portions of the substrate 102 of the BAVA 325 are in contact with the U-channels. However, when the BAVA 325 is engaged with the metallic post assembly 350 and the edge portions of the BAVA 325 are seated within the U-channels 304, edge treatment is provided in that the edge portions of the substrate 102 of the BAVA 325 are received by the U-channels 304 of the post assembly 350, however, the conductors (104, 106) of the BAVA 325 are not in physical contact with the U-channels 304, nor are the conductors (104, 106) of the BAVA 325 in electrical contact with the U-channels 304. In applications in which an antenna array including multiple BAVAs (ex.—multiple BAVA elements) 325 is being implemented, the metallic post assembly 350 may be configured between adjacent BAVA elements 325, thereby providing capacitance to ground, promoting increased capacitance and/or coupling between the neighboring elements 325 and increasing operational bandwidth (ex.—by moving the lower frequency band end). With current BAVA Electronically Scanned Array (ESA) applications, single polarization of the BAVA ESAs* require metallic crosswalls between the radiating elements to prevent scan-blindness (ex.—in the case of cBAVA and BAVAm) and to reduce small impedance ripples (ex.—in the case of DmBAVA and DmBAVA-MAS).

Figure 6:
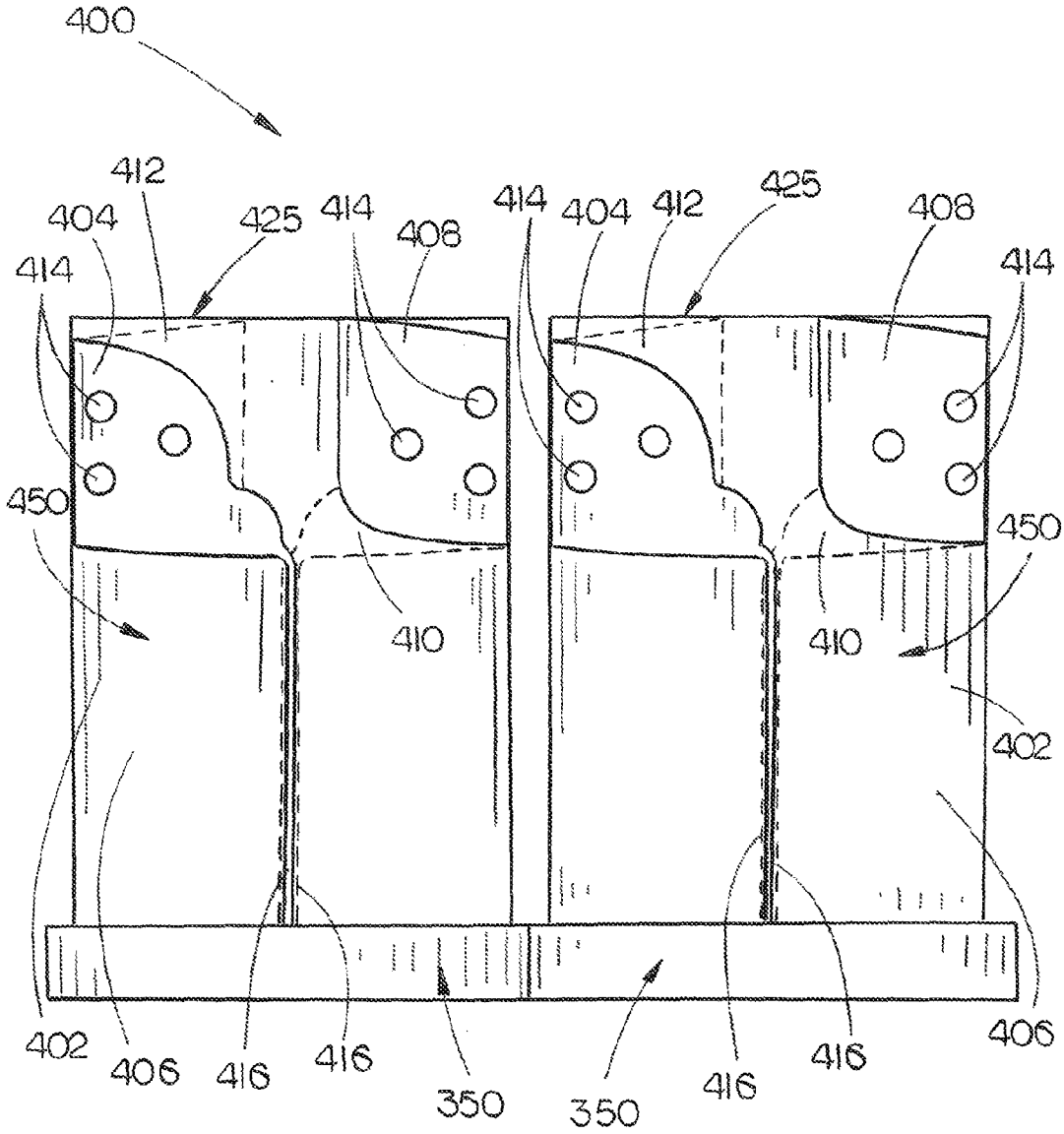
FIG. 6 is a top plan view of an antenna array including a plurality of BAVA unit cells in accordance with a further exemplary embodiment of the present disclosure.

Referring to FIG. 6, an antenna array 400 including a plurality of BAVA unit cells 425 in accordance with a further exemplary embodiment of the present disclosure are shown. The BAVA unit cells 425 shown in FIG. 6 may be similar to and/or may be constructed in a manner similar to the BAVA unit cell 300 shown in FIG. 5, except as described below. In exemplary embodiments of the present disclosure, a BAVA 450 (as shown in FIGS. 6, 16, 17A, 17B and 17C) of the BAVA unit cell 425 may include a substrate 402. Further, the BAVA 450 may include a first outer conductor 404, said first outer conductor 404 being connected to (ex.—configured upon) a first (ex.—top) external surface 406 (ex.—of a first layer/top conductor layer 415) of the substrate 402. In current exemplary embodiments of the present disclosure, the BAVA 450 further includes a second outer conductor 407, said second outer conductor being connected to (ex.—configured upon) a second (ex.—bottom) external surface 409 (ex.—of a third layer/bottom conductor layer 419) of the substrate 402. In further embodiments of the present disclosure, the BAVA 450 further includes a third outer conductor 408, said third outer conductor 408 being connected to (ex.—configured upon) the top external surface 406 (ex.—of the first layer/top conductor layer 415) of the substrate 402. In further embodiments of the present disclosure, the BAVA 450 further includes a fourth outer conductor 413, said fourth outer conductor being connected to (ex.—configured upon the bottom external surface 409 (ex.—of the third layer/bottom conductor layer 419) of the substrate 402. In further embodiments of the present disclosure, the BAVA 450 further includes a first embedded conductor 410 and a second embedded conductor 412, said embedded conductors being embedded within a second layer (ex.—middle conductor layer) 417 of the substrate 402. In still further embodiments of the present disclosure, the first outer conductor 404, the second embedded conductor 412 and the second outer conductor 407 are each configured with a plurality of vias 414 formed therethrough for allowing the first outer conductor 404, the second embedded conductor 412 and/or the second outer conductor 407 to be electrically connected to each other. In still further embodiments of the present disclosure, the third outer conductor 408, the first embedded conductor 410 and the fourth outer conductor 413 are each configured with a plurality of vias 414 formed therethrough for allowing the third outer conductor 408, the first embedded conductor 410 and/or the fourth outer conductor 413 to be electrically connected to each other. The third outer conductor 408, the second embedded conductor 412 and the fourth outer conductor 413 may be formed as additional metallic structures of the BAVA 450

Figure 7:
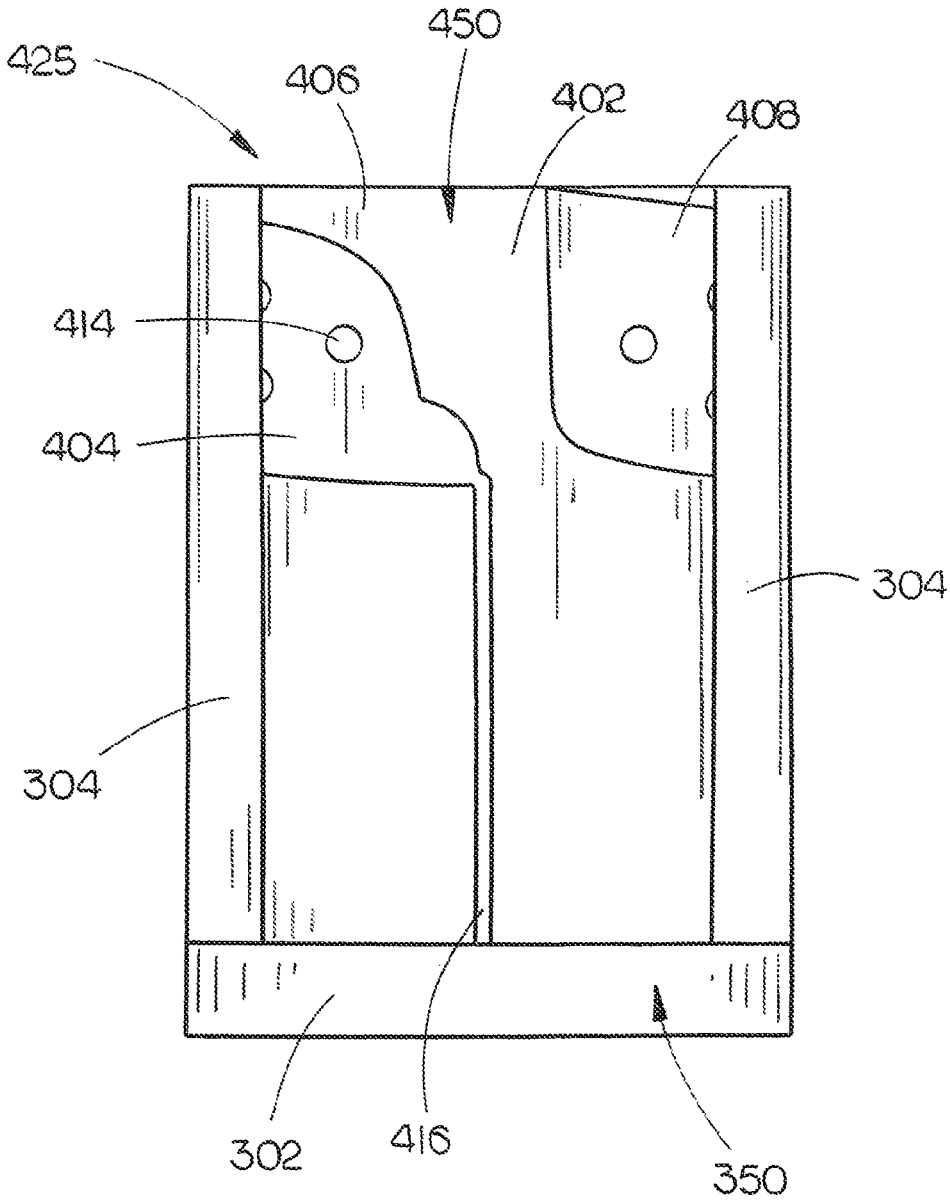
FIG. 7 is a top plan view of a BAVA unit cell in accordance with a further exemplary embodiment of the present disclosure.

In current exemplary embodiments of the present disclosure, the BAVA 450 may include a plurality of feed structures 416, each configured for providing an electrical feed to the conductors of the BAVA 450. The BAVAs 450 shown in FIGS. 6 and 16 may promote improved broadband performance, increased capacitance and improved impedance match compared with currently available BAVA designs, without sacrificing modularity. For example, the BAVA 450 may provide VSWR<2.75 across a 9:1 bandwidth. As shown in FIG. 6, the BAVAs 450 may each be connected with (ex.—engaged within) a metallic post assembly 350, to provide the BAVA unit cells 425 shown. Still further, the BAVA unit cells 425 may be positioned adjacent to each other as shown to form the antenna array 400. FIG. 6 shows the BAVAs 450 engaged within the metallic post assembly 350, however, the U-channel modules 304 of the metallic post assembly 350 are not shown for clarity. FIG. 7 shows a view of the BAVA 450 engaged within the metallic post assembly where the U-channel modules are shown.

Figure 8:
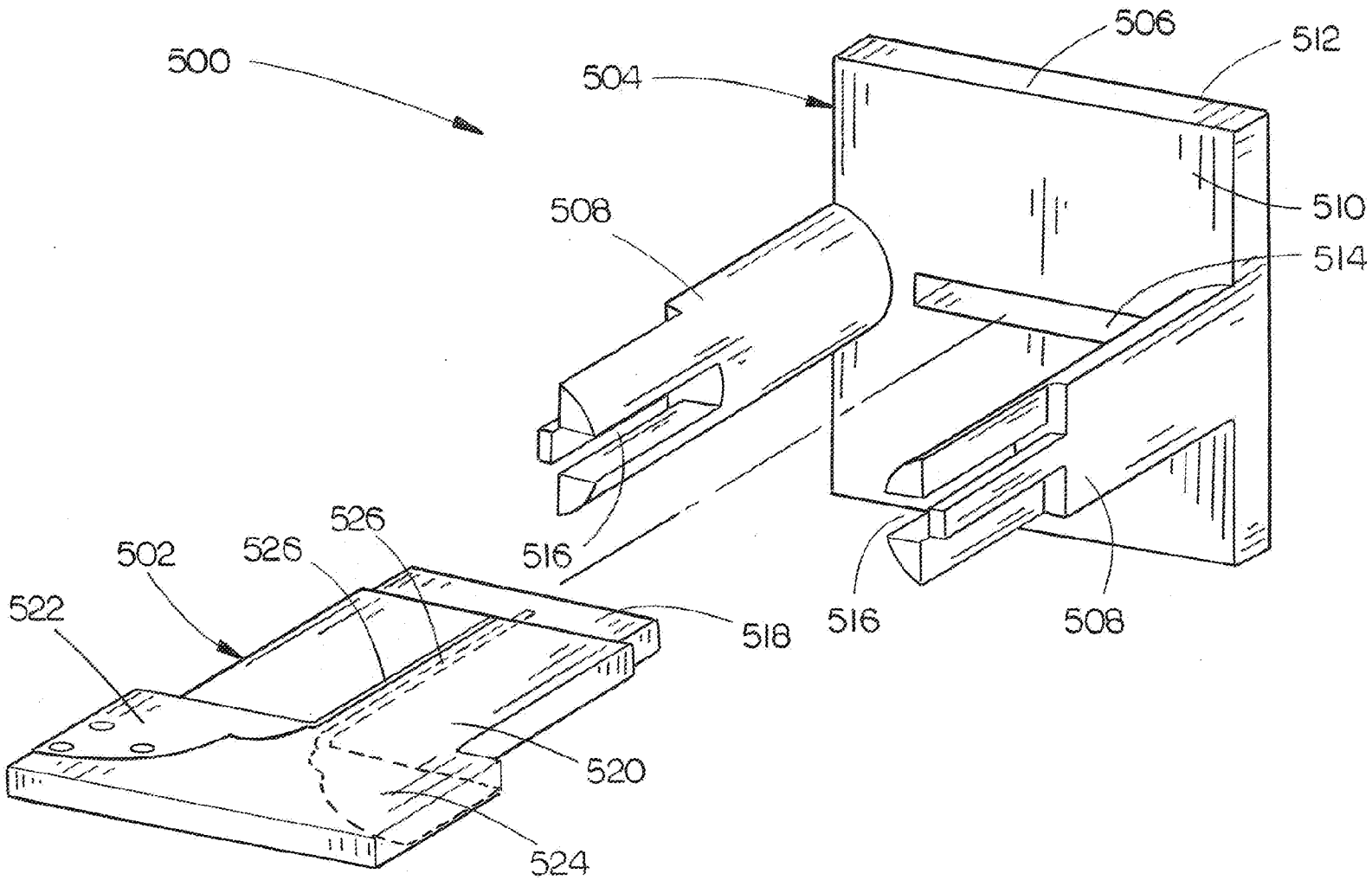
FIG. 8 is an exploded view of a BAVA unit cell in accordance with a further exemplary embodiment of the present disclosure.
Figure 9:
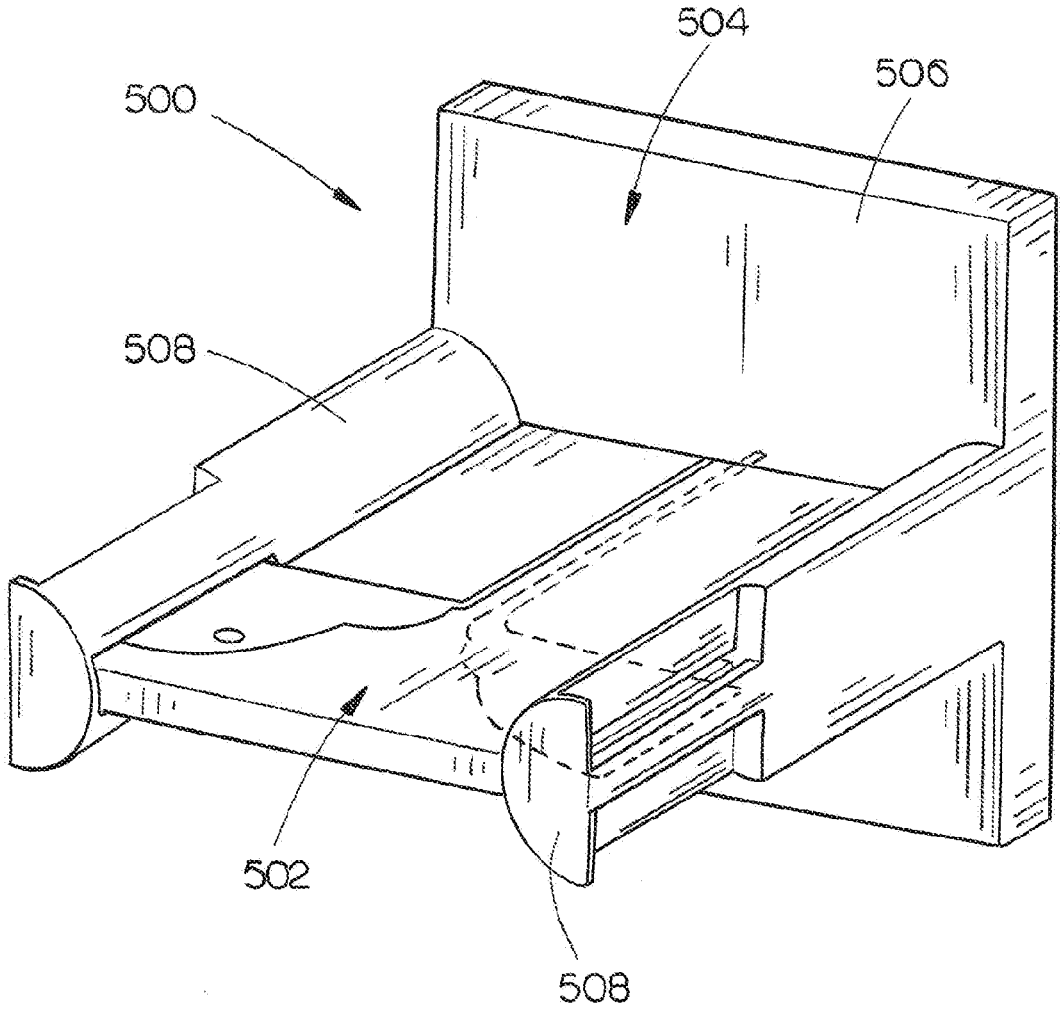
FIG. 9 is an isometric view of the BAVA unit cell shown in FIG. 8, in accordance with a further exemplary embodiment of the present disclosure.

Referring to FIG. 8, a BAVA unit cell 500 in accordance with a further exemplary embodiment of the present disclosure is shown. The BAVA unit cell 500 shown in FIG. 8 may be similar to and/or may be constructed in a manner similar to any one of the other BAVA unit cell embodiments disclosed herein, except as described below. The BAVA unit cell 500 includes a BAVA 502 and a post assembly (ex.—metallic post assembly) 504, said BAVA 502 configured for being connected to (ex.—engaged with) the metallic post assembly 504. The metallic post assembly 504 includes a base plate 506 and a plurality of channel modules (ex.—U-channel modules) 508. The base plate 506 includes a front surface 510 and a rear surface 512, the channel modules being connected to (ex—configured upon) the front surface 510. The base plate 506 is further configured with an aperture (ex.—slot) 514 formed therethrough (ex.—formed through the base plate 506) as shown in FIG. 8. The channel modules 508 are configured with (ex.—form) recesses or channels (ex.—U-shaped recesses) 516 which are sized and shaped for receiving (ex.—slidably receiving) edge portions of the BAVA 502, such that said edge portions of the BAVA 502 may be supported by and/or seated within the channel modules 508 when the BAVA 502 is engaged with the metallic post assembly 504 (as shown in FIG. 9). Further, the slot 514 of the base plate 506 may be sized and shaped for receiving (ex.—slidably receiving) a portion of the BAVA 502. Still further, the slot 514, and the channel modules 508 may be aligned for receiving the BAVA 502 in a front engage manner (ex.—an end portion of the BAVA 502 is inserted into the slot 514 via the front surface 510 of the base plate 506) as shown in FIG. 8. The BAVA 502 may include a ground portion 518 for providing a common RF ground with Transmit/Receive (T/R) module (not shown), if necessary. In further embodiments, the BAVA 502 may include a substrate 520, a plurality of outer conductors 522 and an embedded conductor 524, said conductors (522, 524) being connected to feed structures 526, said embedded conductor 524 configured for being connected to Transmit/Receive (T/R) circuitry (ex.—driving circuitry and/or feed manifold assembly). The channel modules (ex.—U-channel modules) 508 of the metallic post assembly 504 shown in FIGS. 8 and 9 are optimized for single polarization.

Figure 10:
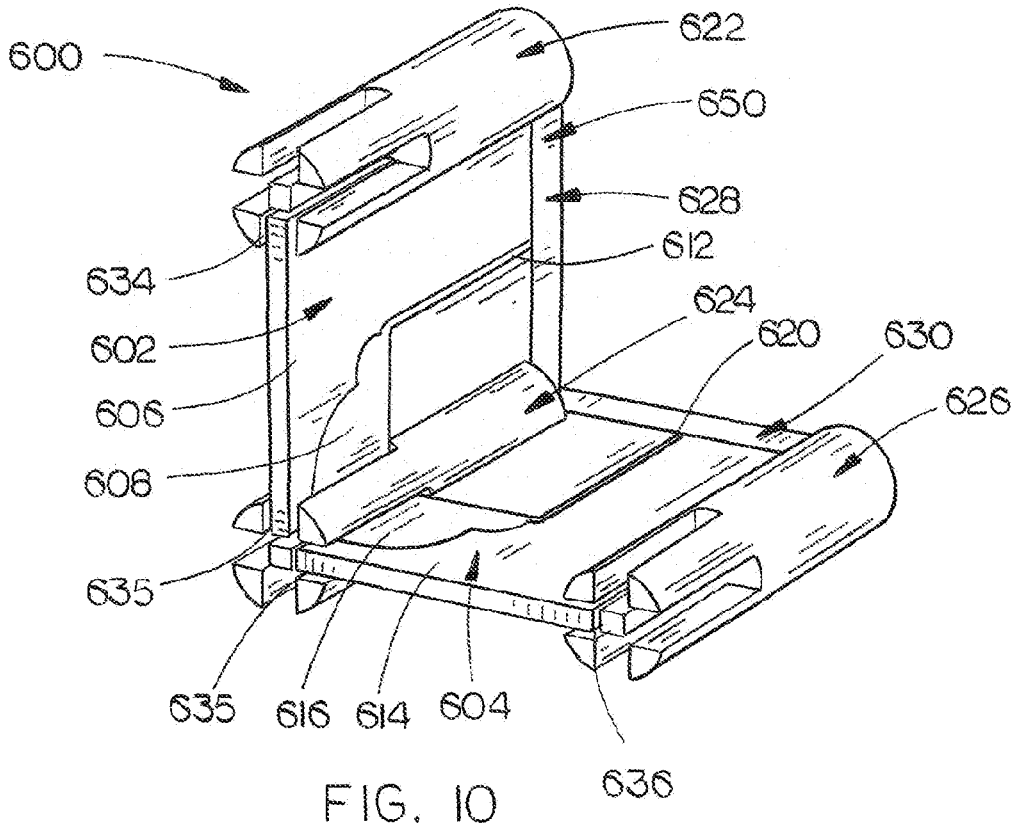
FIG. 10 is an isometric view of a dual-polarized BAVA array in accordance with an exemplary embodiment of the present disclosure.
Figure 11:
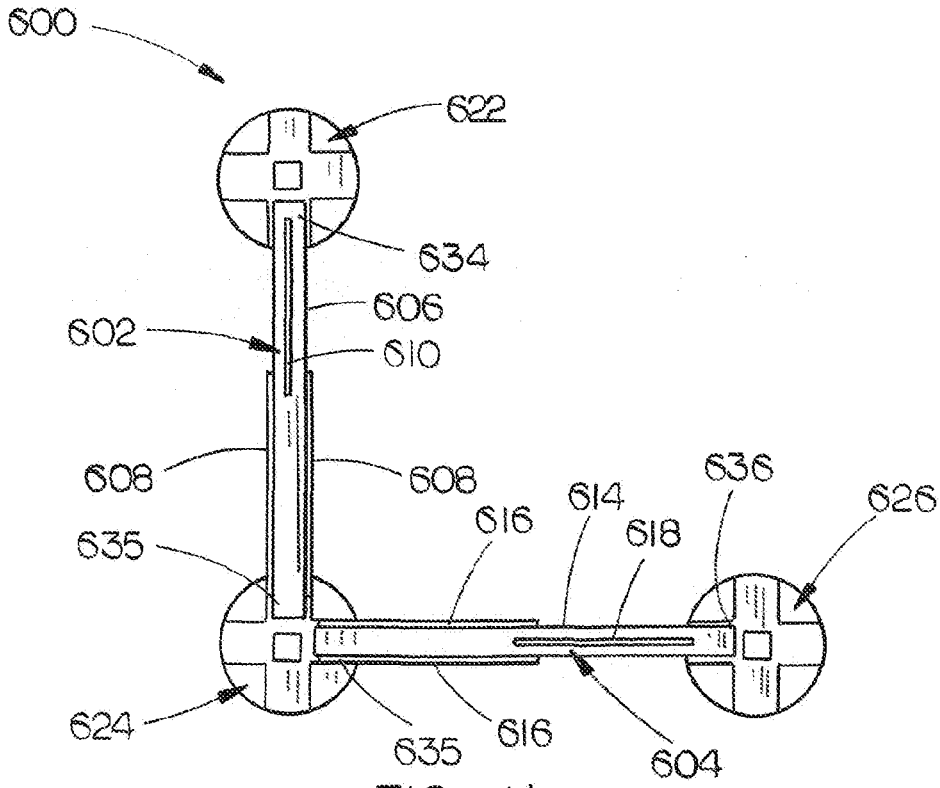
FIG. 11 is a front view of the dual-polarized BAVA array shown in FIG. 10 in accordance with an exemplary embodiment of the present disclosure.

Referring to FIGS. 10 and 11, a dual-polarized antenna array (ex.—dual-polarized unit cell) 600 in accordance with an exemplary embodiment of the present disclosure is shown. The array 600 includes a first BAVA 602 and a second BAVA 604. The first BAVA 602 and the second BAVA 604 may be similar to and/or may be constructed in a manner similar to any one of the BAVA embodiments disclosed herein. For example, the first BAVA 602 includes a substrate 606. The first BAVA 602 further includes outer conductors 608 and an embedded conductor 610, said conductors (608, 610) being connected to feed structures 612. The second BAVA 604 includes a substrate 614. The second BAVA 604 further includes outer conductors 616 and an embedded conductor 618, said conductors (616, 618) being connected to feed structures 620.

The dual-polarized antenna array 600 further includes a cradle assembly (ex.—post assembly) 650. The cradle assembly 650 includes a first channel module 622, a second channel module 624, and a third channel module 626. The channel modules (622, 624, 626) are connected via a generally L-shaped frame including a first frame portion 628 connected to a second frame portion 630. The first channel module 622 has a plurality of recesses (ex.—notches, channels) 634 formed therein, each of the recesses being sized and shaped for receiving (ex.—seating) an edge portion of a BAVA substrate. For example, the first channel module 622 may receive a first edge portion of the substrate 606 of the first BAVA 602. Further, the second channel module 624, which is connected to the first channel module 622 via the first frame portion 628 of the cradle assembly 650 may have a plurality of channels (634, 635) formed therein, each of the channels being sized and shaped for receiving an edge portion of a BAVA substrate. For example, the second channel module 624 may receive a second edge portion of the substrate 606 of the first BAVA 602. Still further, the first frame portion 628 of the cradle assembly 650 may be configured with a recess or slot (not shown) formed therein and/or therethrough for receiving an end portion (ex.—third edge portion) of the substrate 606 of the first BAVA 602. For example, the first BAVA 602 may be slidably engaged with the cradle assembly 650 such that the first edge portion, the second edge portion, and the third edge portion of the substrate 606 of the first BAVA 602 are received (ex.—seated and/or supported) within the channel 634 of the first channel module 622, a first channel 634 included in the plurality of channels of the second channel module 622, and the slot or channel (not shown) of the first frame portion, respectively.

Figure 20:
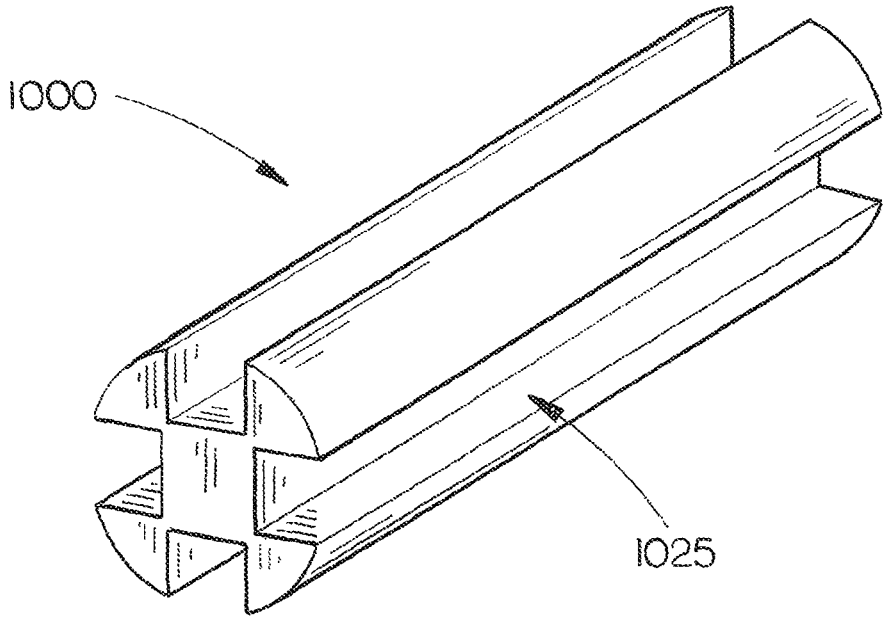
FIG. 20 is an isometric view of a channel module configured with a U-shaped channel which runs the full length of the channel module for promoting front or rear insert of a BAVA substrate into the channel module in accordance with a further exemplary embodiment of the present disclosure.
Figure 21:
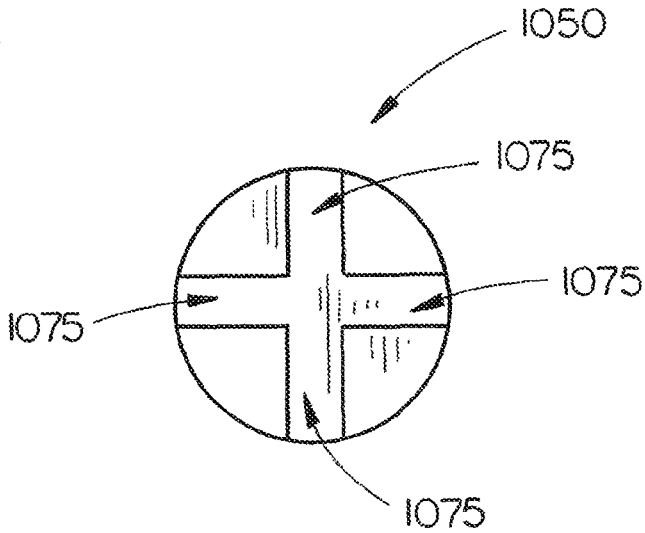
FIG. 21 is an end view of a channel module configured with through channels in accordance with a further exemplary embodiment of the present disclosure.

In further embodiments of the present disclosure, the second channel module 624 includes a second channel 635. For example, the second channel 635 may receive a first edge portion of the substrate 614 of the second BAVA 604. The third channel module 626, which is connected to the second channel module 624 via the second frame portion 630 of the cradle assembly 650 may have a plurality of channels 636 formed therein, each of the channels being sized and shaped for receiving an edge portion of a BAVA substrate. For example, the third channel module 626 may receive a second edge portion of the substrate 614 of the second BAVA 604. Still further, the second frame portion 630 of the cradle assembly 650 may be configured with a recess or slot (not shown) formed therein and/or therethrough for receiving an end portion (ex.—third edge portion) of the substrate 614 of the second BAVA 604. For instance, the second BAVA 604 may be slidably engaged with the cradle assembly 650 such that the first edge portion, the second edge portion, and the third edge portion of the substrate 614 of the second BAVA 604 are received (ex.—seated and/or supported) within the second channel 635 of the second channel module 624, a channel 636 included in the plurality of channels of the third channel module 624, and the slot or channel (not shown) of the second frame portion, respectively. When the first BAVA 602 and the second BAVA 604 are engaged within the cradle assembly 650, the dual-polarized antenna array (ex.—dual-polarized unit cell) 600 is formed, with the first BAVA 602 providing (ex.—acting as) a vertical polarization BAVA input and the second BAVA 604 providing (ex.—acting as) a horizontal polarization BAVA input for the array 600. Further, when the first BAVA 602 and the second BAVA 604 are engaged within the cradle assembly 650, the first BAVA 602 may be oriented perpendicular to the second BAVA 604 as shown in FIGS. 10 and 11. In further embodiments of the present disclosure, the frame portions (628, 630) may be configured as part of and/or may be connected to base plates (not shown), such as the base plates of the post assembly (ex.—metallic post assembly) embodiments described herein. In alternative embodiments of the present disclosure, the channel modules (622, 624, 626) and the channels 636 of the channel modules (622, 624, 626) may be varying shapes and/or sizes. For example, FIG. 20 illustrates a channel module 1000 which may be constructed to have (to form) one or more recesses (ex.—U-shaped channel) 1025 which extend or run the full length of the channel module 1000 (ex.—and may extend through front and rear ends of the channel module 1000) for allowing front or rear insert of a BAVA substrate into the channel module 1000. Further, FIG. 21 illustrates a channel module 1050 which is constructed such that the recesses 1075 are through recesses which extend the full length and width of the channel module 1050 and extend through the channel module 1050 (ex.—said recesses 1075 are not separated from each other via a mechanical structure. There are various shapes, sizes and configurations which may be implemented for the channel modules and their channels. In further embodiments of the present disclosure, the channels may not run the full length of the channel module and the ground plane may have a smaller slot.

Figure 12:
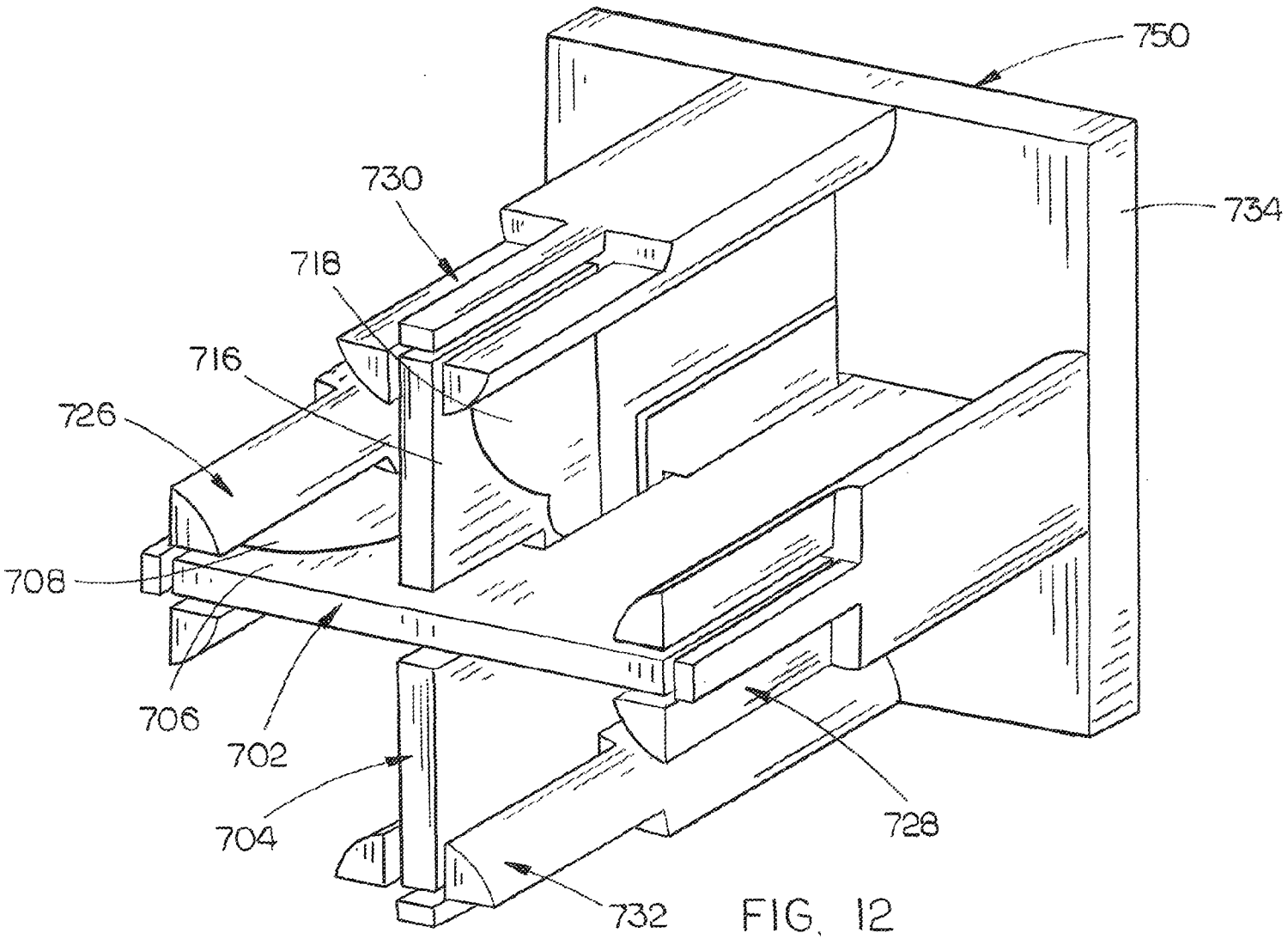
FIG. 12 is an isometric view of a BAVA array, wherein the BAVA elements are configured in an orthogonal orientation relative to each other, in accordance with a further exemplary embodiment of the present disclosure.
Figure 14:
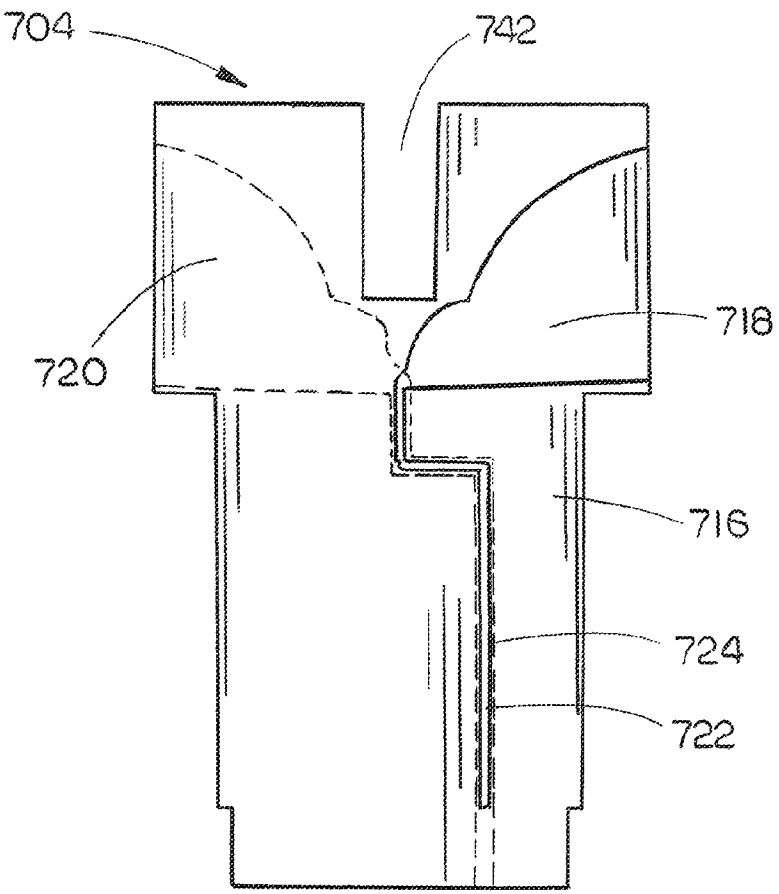
FIG. 14 is a top plan view of a vertical polarization BAVA element of the BAVA array shown in FIG. 12, in accordance with an exemplary embodiment of the present disclosure.
Figure 13:
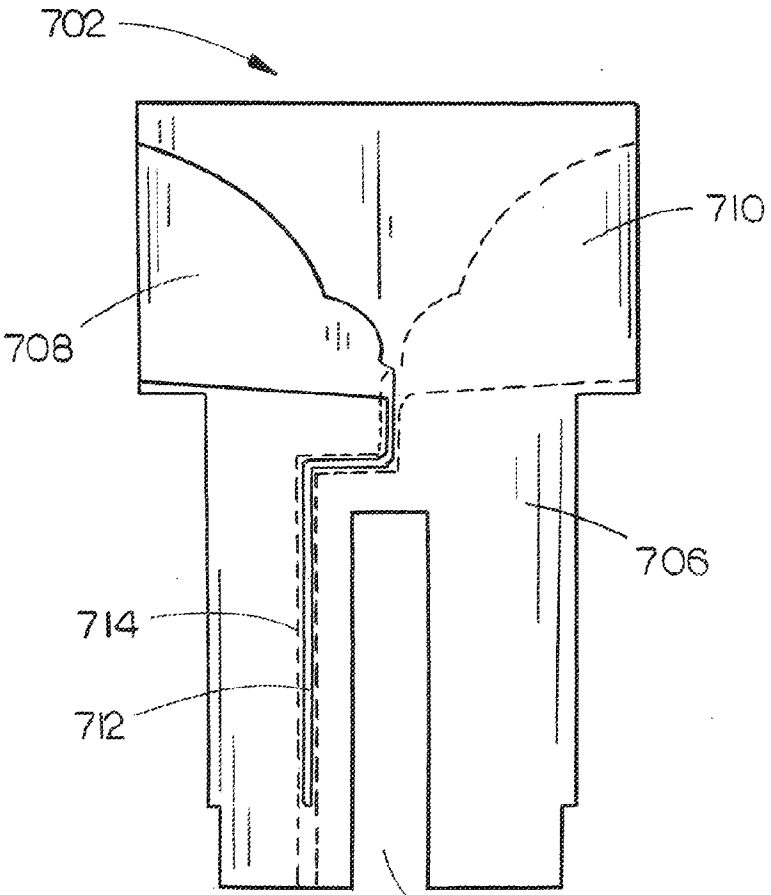
FIG. 13 is a bottom plan view of a horizontal polarization BAVA element of the BAVA array shown in FIG. 12, in accordance with an exemplary embodiment of the present disclosure.
Figure 15:
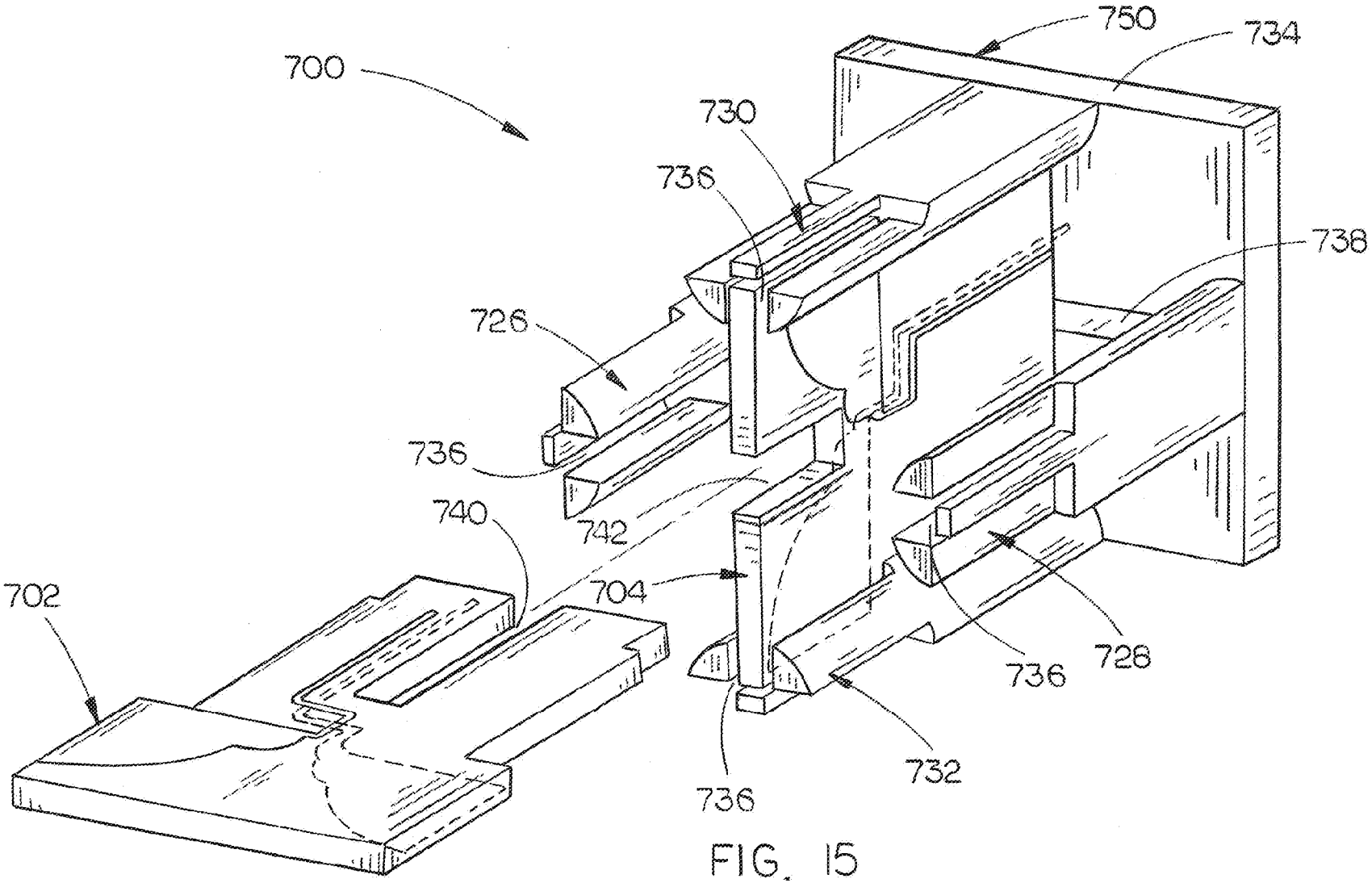
FIG. 15 is an exploded, isometric view of the BAVA array shown in FIG. 12, in accordance with an exemplary embodiment of the present disclosure.
Figure 16:
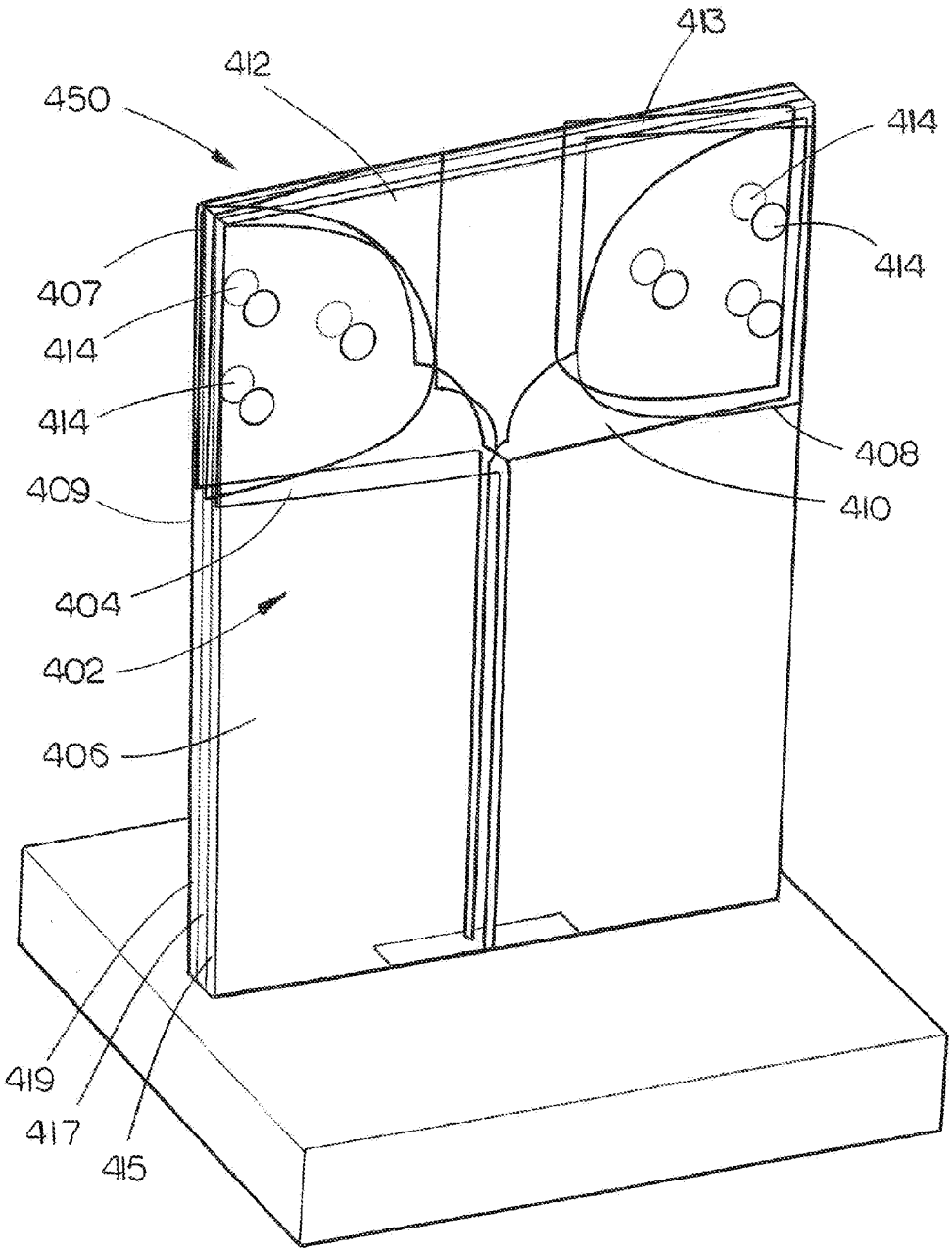
FIG. 16 is a front isometric view of a BAVA having multi-stage conductors (ex.—fins) and additional metallic structure within the three metallic conductor layers of the BAVA in accordance with a further exemplary embodiment of the present disclosure.
Figure 17C:
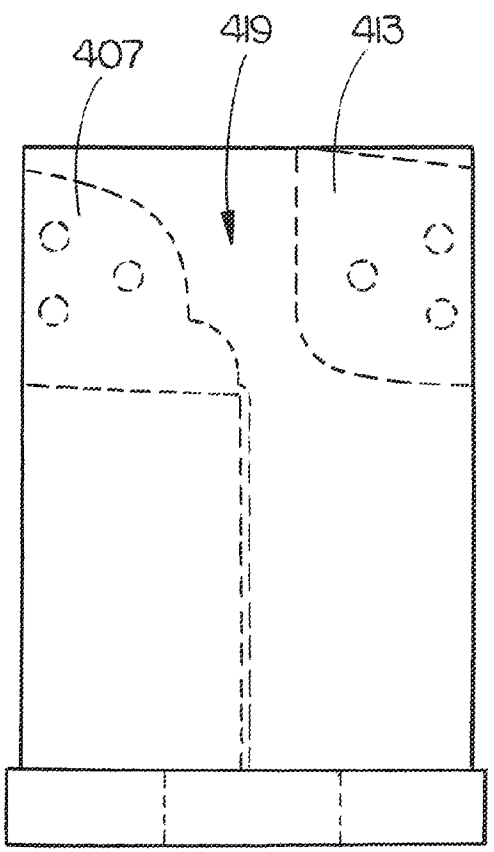
FIGS. 17A, 17B and 17C are individual top plan views of each of the individual metallic conductor layers (ex.—top, middle and bottom conductor layers respectively) of the BAVA shown in FIG. 16 in accordance with a further exemplary embodiment of the present disclosure.
Figure 17B:
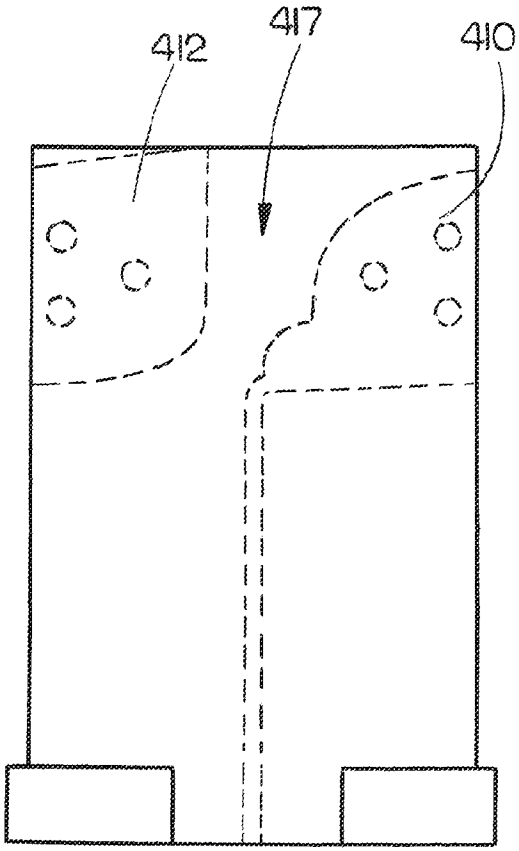
Figure 17A:
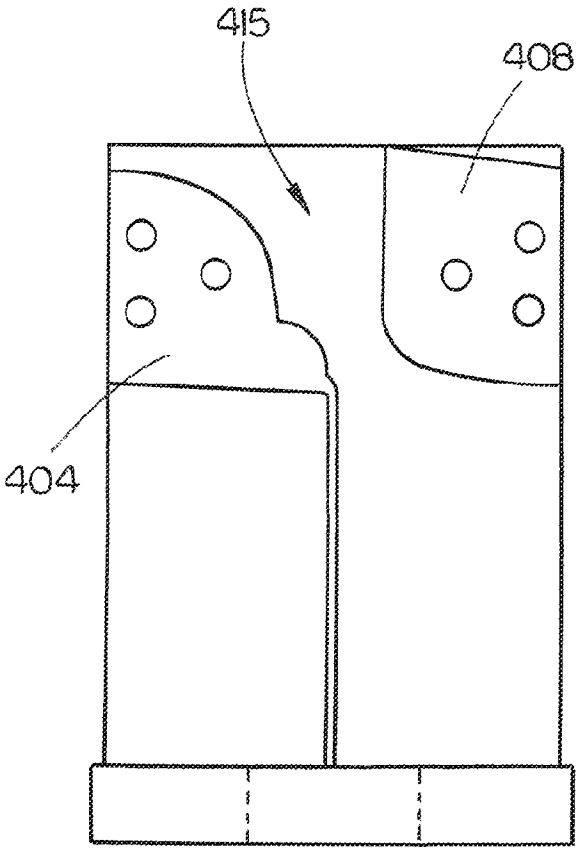

Referring to FIGS. 12 and 15, a dual-polarized antenna array (ex.—dual-polarized unit cell) 700 in accordance with a further exemplary embodiment of the present disclosure is shown. The array 700 includes a first BAVA 702 and a second BAVA 704. The first BAVA 702 and the second BAVA 704 may be similar to and/or may be constructed in a manner similar to any one of the BAVA embodiments disclosed herein, except as described below. For example, the first BAVA 702 includes a substrate 706. The first BAVA 702 further includes outer conductors 708 and an embedded conductor 710, said conductors (708, 710) being connected to feed structures (712, 714) (as shown in FIG. 13). The second BAVA 704 includes a substrate 716. The second BAVA 704 further includes outer conductors 718 and an embedded conductor 720, said conductors (718, 720) being connected to feed structures (722, 724) (as shown in FIG. 14).

The dual-polarized antenna array 700 further includes a cradle assembly (ex.—post assembly, metallic post assembly) 750. The cradle assembly 750 includes a first channel module 726, a second channel module 728, a third channel module 730 and a fourth channel module 732. The channel modules (726, 728, 730, 732) are connected to (ex.—configured upon) a base plate 734 Each of the channel modules (726, 728, 730, 732) has a recess (ex.—notch, channel) 736 formed therein, each of the channels 736 being sized and shaped for receiving (ex.—seating) an edge portion of a BAVA substrate. For example, the channel 736 of the first channel module 726 may receive a first edge portion of the substrate 706 of the first BAVA 702. Further, the channel 736 of the second channel module 728 may receive a second edge portion of the substrate 706 of the first BAVA 702. Further, the channel 736 of the third channel module 730 may receive a first edge portion of the substrate 716 of the second BAVA 704. The channel 736 of the fourth channel module 732 may receive a second edge portion of the substrate 716 of the second BAVA 704. The base plate 734 may be configured with one or more slot(s) 738 formed therein and/or therethrough, said slot(s) being configured for receiving third edge portion(s) (ex.—end portion(s)) of the first BAVA 702 and/or the second BAVA 704. In an exemplary embodiment of the present disclosure, the slots 738 of the base plate 734 may be configured in an orthogonal orientation relative to each other. For example, the first BAVA 702 may be slidably engaged with the cradle assembly 750 such that the first and second edge portions of the substrate 706 may be received (ex.—seated within) the channels 736 of the first channel module 726 and the second channel module 728 respectively (as shown in FIG. 12). Further, the second BAVA 704 may be slidably engaged with the cradle assembly 750 such that the first and second edge portions of the substrate 716 may be received (ex.—positioned within) the channels 736 of the third channel module 730 and the fourth channel module 732 respectively (as shown in FIG. 12).

In further embodiments of the present disclosure, the substrate 706 of the first BAVA 702 is configured with a slot (ex.—notch) 740 (as shown in FIG. 13) and the substrate 716 of the second BAVA 704 is also configured with a slot (ex.—notch) 742 (as shown in FIG. 14). The slots (740, 742) allow for interleaving (ex.—along the centers rather than the edges) of the BAVAs (ex.—BAVA elements) 702, 704, such that: the slot 740 of the substrate 706 of the first BAVA 702 is sized and shaped for receiving a portion of the substrate 716 of the second BAVA 704; and the slot 742 of the substrate 716 of the second BAVA 704 is sized and shaped for receiving a portion of the substrate 706 of the first BAVA 702. For example, the slots (740, 742) of the substrates (706, 716) allow the BAVAs (ex.—BAVA elements) 702, 704 to be orthogonally positioned relative to each other as shown in FIGS. 12 and 15 when received within the cradle assembly 750. The first BAVA 702 and the second BAVA 704 may be linearly-polarized elements. The first BAVA 702 may be a horizontal polarization element, while the second BAVA 704 may be a vertical polarization element. The dual-polarized antenna array 700 shown in FIGS. 12 and 15 provides a coincident phase center, ultra wide band (UWB) electronically scanned array (ESA) which provides polarization agility and diversity. Depending on the excitation coefficients, the array 700 may have dual-linear polarization, slant polarization and circular polarization. Further, the elements 702, 704 do not interfere with each other mechanically, or electrically. The configuration of the array 700 brings excitation lines close (ex.—fed by planar circuit rather than perpendicular circuit). Further, the array 700 may alleviate issues of polarization purity degrading at off-broadside angles. Still further, the cradle assembly 750 may be configured for facilitating the transition between the radiating elements (702, 704) and a Transmit/Receive (T/R) module and/or feed manifold (not shown).

Figure 18:
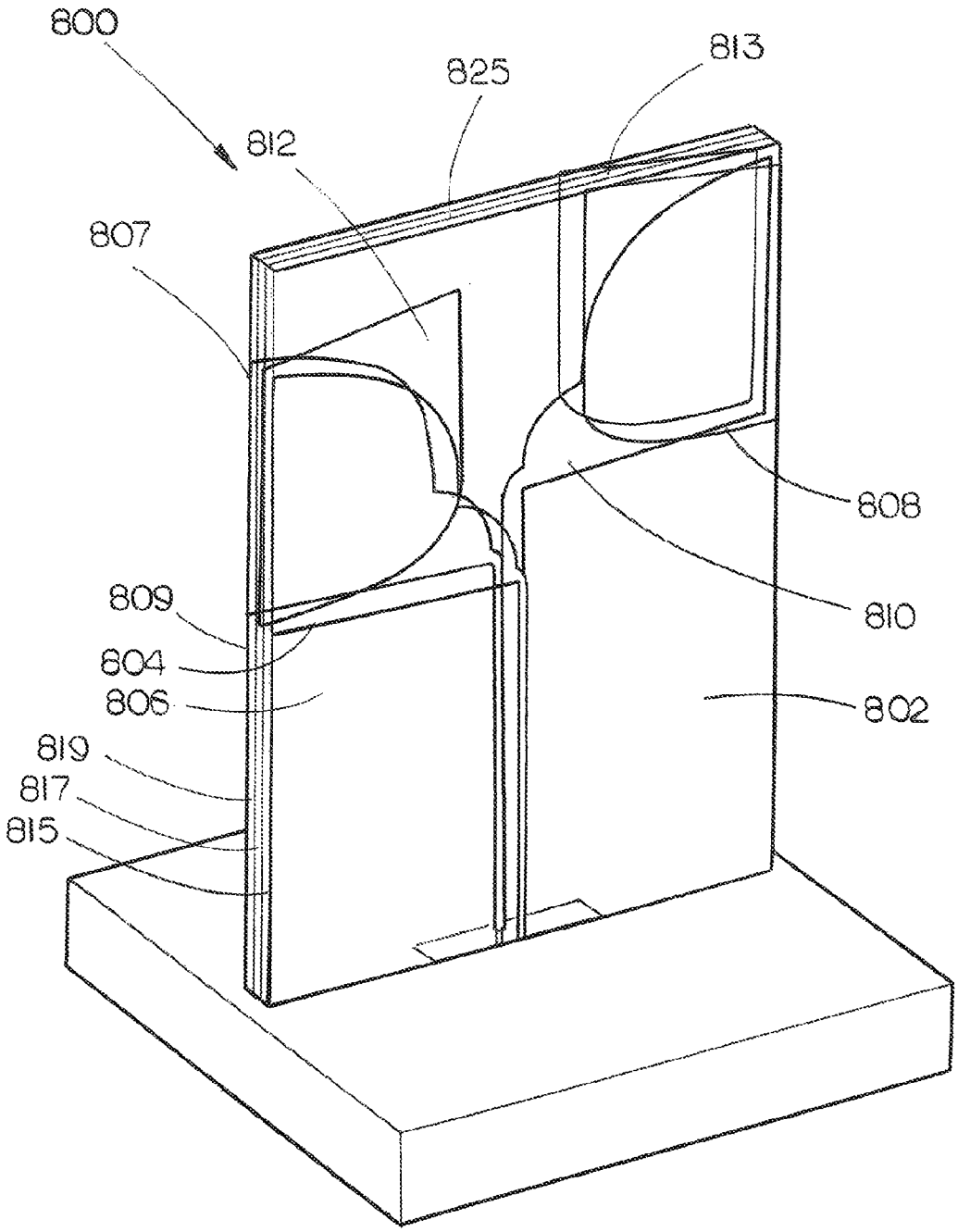
FIG. 18 is a front isometric view of an asymmetric BAVA having multi-stage fins and additional metallic structures in the conductor layers of the BAVA substrate, in accordance with a further exemplary embodiment of the present disclosure.

Referring to FIG. 18, an asymmetric BAVA having multi-stage fins and additional metallic structures of (exs.—on or within) the conductor layers of the substrate of the BAVA in accordance with an exemplary embodiment of the present disclosure is shown. The asymmetric BAVA 800 may have one or more characteristics of one or more of the BAVA embodiments described above. In an exemplary embodiment of the present disclosure, the asymmetric BAVA 800 may include a substrate 802. The BAVA 800 may further include a first outer conductor 804, said first outer conductor 804 being connected to (ex.—configured upon) a first (ex.—top) external surface 806 (ex.—of a first layer/top conductor layer 815) of the substrate 802. In current exemplary embodiments of the present disclosure, the BAVA 800 further includes a second outer conductor 807, said second outer conductor 807 being connected to (ex.—configured upon) a second (ex.—bottom) external surface 809 (ex.—of a third layer/bottom conductor layer 819) of the substrate 802. In further embodiments of the present disclosure, the BAVA 800 further includes additional structures (ex.—additional metallic structures) such as a third outer conductor 808 and a fourth outer conductor 813, said third outer conductor 808 being connected to (ex.—configured upon) the top external surface 806 (ex.—of the first layer/top conductor layer 815) of the substrate 802, said fourth outer conductor 813 being connected to (ex.—configured upon) the bottom external surface 809 (ex.—of the third layer/bottom conductor layer 819) of the substrate 802. In further embodiments of the present disclosure, the BAVA 800 further includes a first embedded conductor 810 and a second embedded conductor 812 said embedded conductors (810, 812) being embedded within a second layer (ex.—middle conductor layer) 817 of the substrate 802. In still further embodiments of the present disclosure, the conductors (804, 807, 808, 810, 812, 813) may be configured with a plurality of vias (not shown) formed therethrough for allowing each of said conductors to be electrically connected to one or more of the remaining said conductors. As shown in FIG. 18, the BAVA 800 may be an asymmetric BAVA 800 such that the third outer conductor 808, the first embedded conductor 810 and the fourth outer conductor 813 may each be oriented such that they are more proximally located to (ex.—extend further towards) a top edge 825 of the substrate 802 compared to the first outer conductor 804, the second outer conductor 807 and the second embedded conductor 812. The third outer conductor 808, the second embedded conductor 812 and the fourth outer conductor 813 may be formed as additional metallic structures for the BAVA 800.

Figure 19:
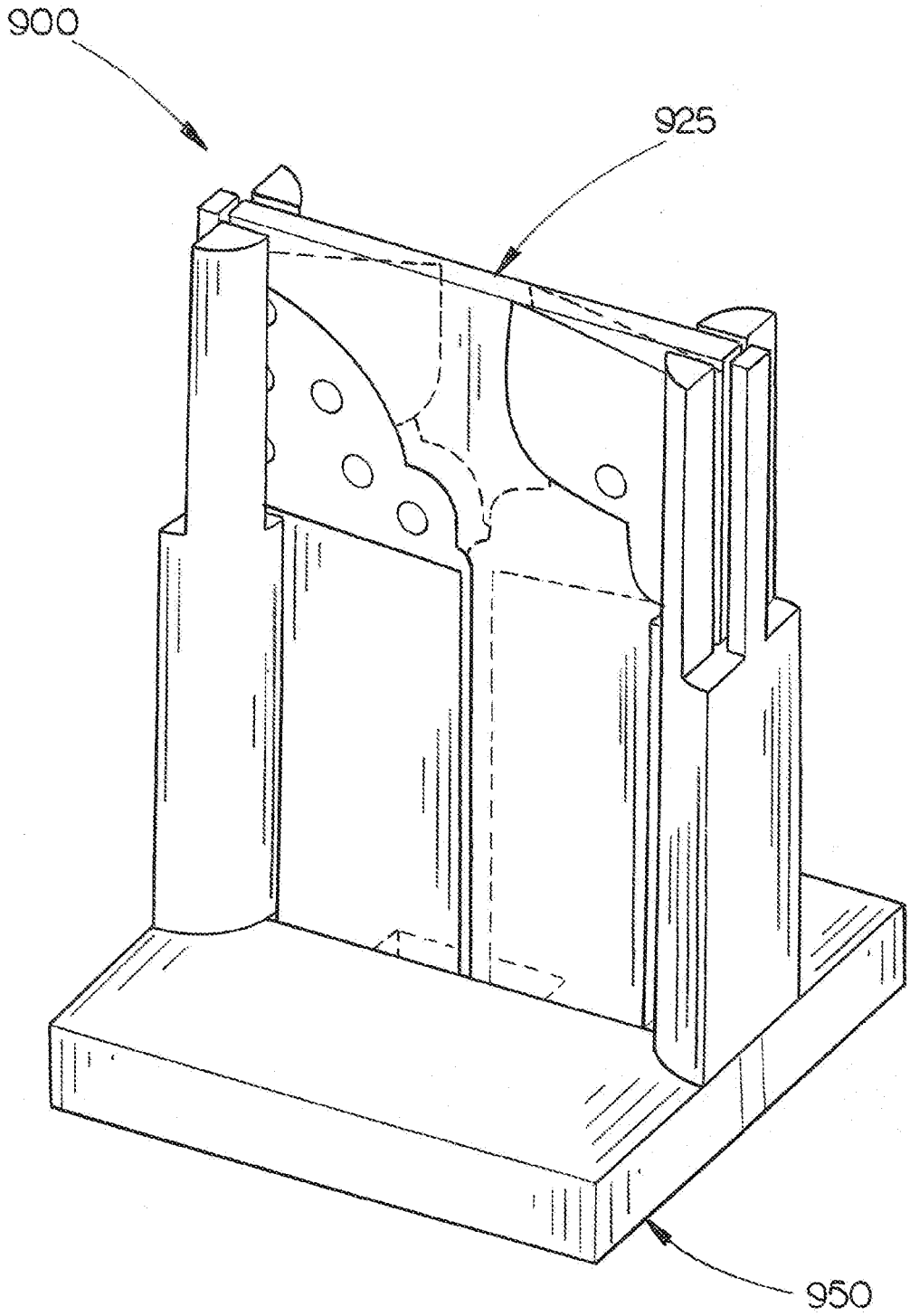
FIG. 19 is a BAVA unit cell (ex—BAVA unit and post cell), said BAVA of the BAVA unit cell having multi-stage fins and additional metallic structures in the conductor layers of the BAVA substrate in accordance with a further exemplary embodiment of the present disclosure.

Referring to FIG. 19, a BAVA unit cell (ex.—BAVA unit and post cell) in accordance with a further exemplary embodiment of the present disclosure. The BAVA unit cell 900, which includes a BAVA 925 engaged within a post assembly 950 may be similar to (ex.—may include one or more characteristics of) the BAVA unit cell 500 shown in FIG. 8, except that the BAVA 925 of the BAVA unit cell 900 shown in FIG. 19 may have multi-stage fins and additional metallic structures in the conductor layers of the substrate, such as BAVAs (450, 800) described above.

Figure 22:
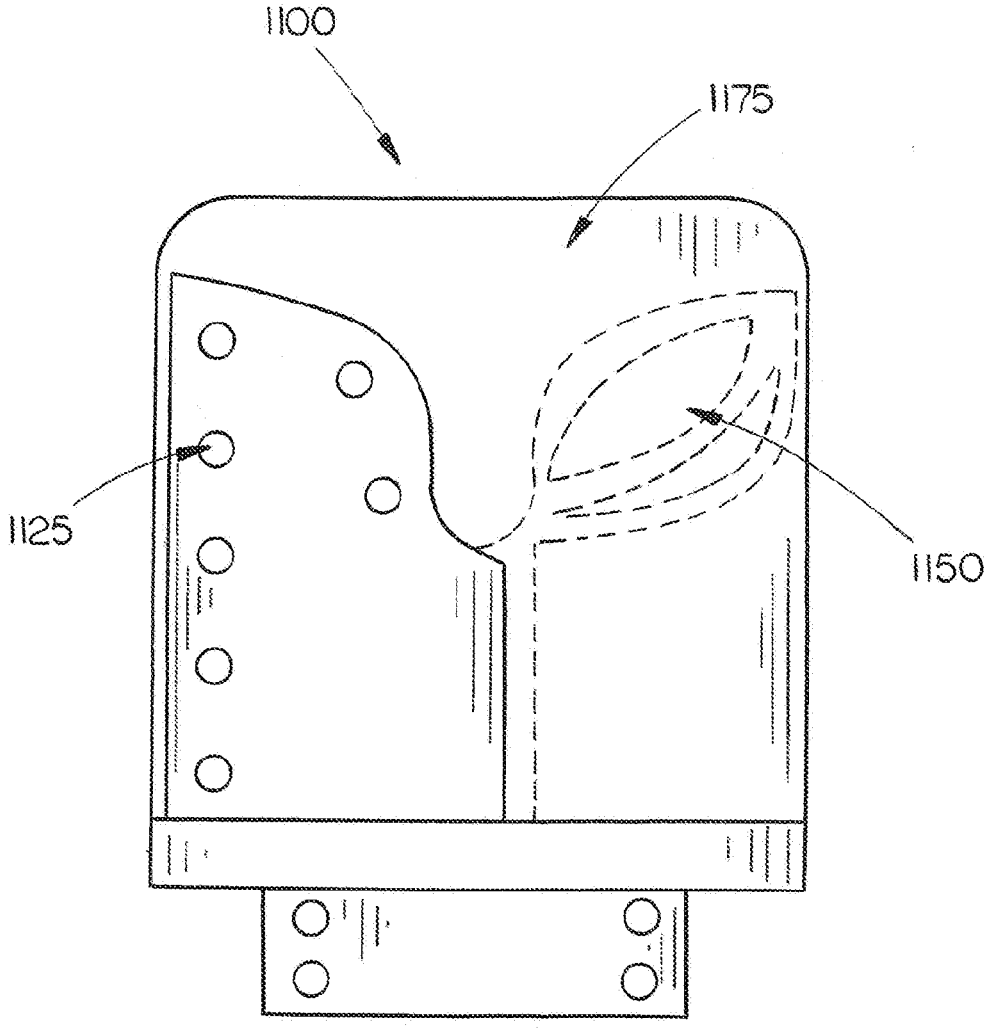
FIG. 22 is top plan view of a BAVA in which an outer conductor of the BAVA is shaped differently than the embedded conductor in accordance with a further exemplary embodiment of the present disclosure.

In further embodiments of the present disclosure, the conductors (ex.—outer conductors and embedded conductors) of a BAVA may have different shapes and sizes relative to each other. FIG. 22 illustrates a BAVA 1100 in which an outer conductor 1125 of the BAVA 1100 is shaped differently (ex.—occupies a larger footprint on or within the substrate 1175) than the embedded conductor 1150. Many different sizes, shapes and configurations may be used for the conductors of the BAVAs.

In still further embodiments of the present disclosure, conductive stripes assembly may be printed on additional substrate material which may be laminated onto the original BAVA structure. The conductive stripes assembly may include a plurality of arbitrary shapes to imitate the capacitive coupling effect of the U-shaped channels. In further embodiments of the present disclosure, the conductors (outer and embedded) may be formed of metal (ex.—may be metallic conductors).

In further embodiments of the present disclosure, tiling of a BAVA subarray may be done in order to realize an electrically large aperture. For example, a dual orthogonal polarization BAVA unit cell subarray tile may be created, said tile having m×n (row by column) dual polarization BAVA elements. In an exemplary embodiment of the present disclosure, the subarray tile is a building block for a modular, electrically large, electronically scanned antenna. Each subarray tile includes a ground plane, said ground plane of each subarray tile being slotted for accepting BAVA elements. Each subarray tile includes a mechanism for mechanically and electrically connecting to its contiguous neighbor subarray tiles and/or to a mounting plate to provide adequate mechanical structure and/or continuous electrical grounding.

The antenna enhancements provided by this disclosure can be applied to the geometry of elements of a conventional Vivaldi antenna and any Vivaldi-like, dipole like, antenna structure (such as AVA, BAVA, double-dipole antenna, Bunny-ear antenna, or bow-tie antennas.)

The Balanced Antipodal Tapered Slot Antenna (ex.—BAVA/BAVA antenna) and/or Balanced Antipodal Tapered Slot Antenna Array (ex.—BAVA array/BAVA antenna array) embodiments described herein provide low cost, lightweight, low profile, wideband, wide-scan, phased arrays which may be realized by a modular of radiating elements for military and commercial applications. Further, by utilizing the novel element edge treatments to the BAVA radiating elements as described herein, the embodiments of the present disclosure allow for realization of specific performance enhancements (ex.—Ultra Wide Band (UWB) and high dual polarization isolation) with electrically short BAVA ESA apertures. The BAVA and/or BAVA array embodiments described herein may be implemented in Department of Defense UAS applications, including Miniature Synthetic Aperture Radar (miniSAR), Sense-And-Avoid Radar, miniature Common Data Link (mini-CDL) systems, Electronic Warfare (EW) systems, Satellite Communications (SATCOM) systems, land mobile systems, maritime and airborne Ka Band Data Link systems (ex.—Military Strategic and Tactical Relay (MILSTAR) systems), integrated Global Broadcast Service (GBS)/MILSTAR systems, Ku Band Digital Beam Forming (Ku Band DBF) systems, wideband Electronically Scanned Antenna (ESA) systems, commercial airborne Ku/Ka Broadband Connectivity SATCOM X/Ka band meteorological radar/mmWave imaging systems.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A unit cell, comprising:

a Balanced Antipodal Vivaldi Antenna (BAVA); and a post assembly, the post assembly configured for receiving the BAVA, the post assembly including a base plate, the post assembly further including a plurality of channel modules, said plurality of channel modules being connected to the base plate, wherein a first channel module included in the plurality of channel modules is configured for receiving, via a channel of the first channel module, a first edge portion of a substrate of the BAVA, a second channel module included in the plurality of channel modules is configured for receiving, via a channel of the second channel module, a second edge portion of the substrate of the BAVA, and the base plate is configured for receiving, via an aperture formed through the base plate, a third edge portion of the substrate of the BAVA, the BAVA includes a plurality of conductors, each conductor included in the plurality of conductors including a multi-curve surface, said multi-curve surface including a plurality of curved sub-portions, wherein a first curved sub-portion included in the plurality of curved sub-portions is controlled by a first opening rate and a second curved sub-portion included in the plurality of sub-portions is controlled by a second opening rate, the second opening rate being a different rate than the first opening rate, the plurality of conductors includes a first outer conductor, a second outer conductor and an embedded conductor, the first outer conductor being configured upon a first external surface of the BAVA substrate, the second outer conductor being configured upon a second external surface of the BAVA substrate, the first external surface and the second external surface being located on a generally opposite external faces of the substrate, the embedded conductor being embedded within the substrate, the plurality of conductors further includes a third outer conductor, a fourth outer conductor and a second embedded conductor, the third outer conductor being configured upon the first external surface of the BAVA substrate, the fourth outer conductor being configured upon the second external surface of the BAVA substrate, the second embedded conductor being embedded within the substrate.

2. A unit cell as claimed in claim 1, wherein the channels of the plurality of channel modules are U-shaped channels.

3. A unit cell as claimed in claim 1, wherein the first edge portion of the BAVA substrate is seated within the first channel module, the second edge portion of the BAVA substrate is seated within the second channel module, and the third edge portion of the BAVA substrate is seated within the aperture of the base plate.

4. A unit cell as claimed in claim 1, wherein each conductor included in the plurality of conductors includes a second multi-curve surface, said second multi-curve surface including a plurality of curved sub-portions.

5. A unit cell as claimed in claim 4, wherein a first curved sub-portion included in the plurality of curved sub-portions of the second multi-curve surface is controlled by a third opening rate and a second curved sub-portion included in the plurality of sub-portions of the second multi-curve surface is controlled by a fourth opening rate, the first, second, third and fourth opening rates being different rates.

6. A unit cell as claimed in claim 1, wherein the first outer conductor is configured in a first shape, the embedded conductor being configured in a second shape, the first shape being different than the second shape.

7. A Balanced Antipodal Vivaldi Antenna (BAVA), comprising:

a substrate; and a plurality of conductors connected to the substrate, the plurality of conductors including a first outer conductor, a second outer conductor, a third outer conductor, a fourth outer conductor, a first embedded conductor, and a second embedded conductor, the first outer conductor and the third outer conductor being configured upon a first external surface of the BAVA substrate, the second outer conductor and the fourth outer conductor being configured upon a second external surface of the BAVA substrate, the first external surface and the second external surface being located on a generally opposite external faces of the substrate, the first embedded conductor and the second embedded conductor being embedded within the substrate, wherein at least one conductor included in the plurality of conductors includes a multi-curve surface, said multi-curve surface including a plurality of curved sub-portions, a first curved sub-portion included in the plurality of curved sub-portions being controlled by a first opening rate and a second curved sub-portion included in the plurality of sub-portions being controlled by a second opening rate, the second opening rate being a different rate than the first opening rate.

8. A Balanced Antipodal Vivaldi Antenna (BAVA) as claimed in claim 7, wherein the at least one conductor included in the plurality of conductors includes a second multi-curve surface, said second multi-curve surface including a plurality of curved sub-portions.

9. A Balanced Antipodal Vivaldi Antenna (BAVA) as claimed in claim 8, wherein a first curved sub-portion included in the plurality of curved sub-portions of the second multi-curve surface is controlled by a third opening rate and a second curved sub-portion included in the plurality of sub-portions of the second multi-curve surface is controlled by a fourth opening rate, the first, second, third and fourth opening rates being different rates.

* * * * *